US009085402B2

(12) United States Patent
Key

(10) Patent No.: US 9,085,402 B2
(45) Date of Patent: Jul. 21, 2015

(54) MEDICAL INFORMATION ROTATING LABEL SYSTEM FOR A CONTAINER

(75) Inventor: Stephen M. Key, Modesto, CA (US)

(73) Assignee: Spinlabel Technologies, Inc., Boca Raton, FL (US)

( * ) Notice: Subject to any disclaimer, the term of this patent is extended or adjusted under 35 U.S.C. 154(b) by 0 days.

(21) Appl. No.: 13/587,846

(22) Filed: Aug. 16, 2012

(65) Prior Publication Data

US 2013/0043157 A1 Feb. 21, 2013

Related U.S. Application Data

(60) Provisional application No. 61/524,254, filed on Aug. 16, 2011.

(51) Int. Cl.
*B65D 85/00* (2006.01)
*B65D 23/08* (2006.01)

(52) U.S. Cl.
CPC ..... *B65D 85/00* (2013.01); *B65D 23/085* (2013.01); *B65D 2203/02* (2013.01)

(58) Field of Classification Search
CPC ..... B65D 23/85; B65D 25/20; B65D 51/245; B65D 85/00; B65D 2203/02
USPC ..... 206/459.1; 40/306, 310–311; 156/86, 156/215–289, 344, 387; 283/70, 81
See application file for complete search history.

(56) References Cited

U.S. PATENT DOCUMENTS

| | | | |
|---|---|---|---|
| 332,208 | A | 12/1885 | Noel |
| 736,035 | A | 8/1903 | Stevenson |
| 1,054,826 | A | 3/1913 | Cole |
| 1,064,576 | A | 6/1913 | Washburn |
| 1,145,367 | A | 7/1915 | Herter |
| 1,312,611 | A | 8/1919 | Chess |
| 1,317,660 | A | 9/1919 | Carlson |
| 1,334,031 | A | 3/1920 | Hahn |
| 1,387,625 | A | 8/1921 | Stein |
| 1,486,313 | A | 3/1924 | Van Antwerp |
| 2,013,615 | A | 9/1935 | Haviland Fontan Le Roy |
| 2,013,616 | A | 9/1935 | Rettenmeyer |
| 2,069,609 | A | 2/1937 | Hanson |

(Continued)

FOREIGN PATENT DOCUMENTS

| | | |
|---|---|---|
| AT | 932891 | 4/2002 |
| AT | 1165378 | 9/2004 |

(Continued)

OTHER PUBLICATIONS

International Search Report and Written Opinion mailed May 25, 2012 in Patent Cooperation Treaty Application No. PCT/US12/22609, filed Jan. 25, 2012.
International Search Report and Written Opinion mailed May 23, 2012 in Patent Cooperation Treaty Application No. PCT/US2012/022610, filed Jan. 25, 2012.

(Continued)

*Primary Examiner* — Bryon Gehman
(74) *Attorney, Agent, or Firm* — Carr & Ferrell LLP

(57) ABSTRACT

The present application is directed to rotating label medical information systems for a container and methods thereof. A base label may be adhered to the container, and medical information displayed on the base label. A top label may cover at least a portion of the base label. The top label may be rotatable about the base label. The top label may have multiple transparent windows allowing multiple items of medical information to be visible through the transparent windows when the top label is rotated about the base label.

5 Claims, 31 Drawing Sheets

(56) References Cited

U.S. PATENT DOCUMENTS

| | | | |
|---|---|---|---|
| 2,129,364 | A | 9/1938 | Simons et al. |
| 2,441,607 | A | 5/1948 | Walls |
| 2,468,000 | A | 4/1949 | Taylor |
| 2,487,274 | A | 11/1949 | Schaffer |
| 2,504,076 | A | 4/1950 | Lindblom |
| 2,706,464 | A | 4/1955 | North |
| 2,738,564 | A | 3/1956 | Guianne |
| 2,739,564 | A | 3/1956 | North |
| 2,844,893 | A | 7/1958 | Keller |
| 2,860,431 | A | 11/1958 | Barnum |
| 2,931,657 | A | 4/1960 | Lewis |
| 2,935,814 | A | 5/1960 | Freeze |
| 2,971,283 | A | 2/1961 | Parker |
| 3,233,770 | A | 2/1966 | Waters |
| 3,278,182 | A | 10/1966 | Lescher |
| 3,374,911 | A | 3/1968 | White |
| D210,767 | S | 4/1968 | Anglada |
| 3,375,954 | A | 4/1968 | Arvid Honkanen et al. |
| 3,468,467 | A | 9/1969 | Amberg |
| 3,488,880 | A | 1/1970 | Taylor |
| 3,523,623 | A | 8/1970 | Dorn |
| 3,542,229 | A | 11/1970 | Beyerlein et al. |
| 3,604,584 | A | 9/1971 | Shank |
| 3,633,781 | A | 1/1972 | Zapata |
| 3,733,002 | A | 5/1973 | Fujio |
| 3,750,317 | A | 8/1973 | Morgan |
| 3,766,882 | A | 10/1973 | Babbitt, III |
| 3,779,829 | A | 12/1973 | Wolff |
| 3,865,671 | A | 2/1975 | Kronsder |
| 3,874,977 | A | 4/1975 | Pyles |
| 3,960,713 | A | 6/1976 | Carey |
| 4,044,889 | A | 8/1977 | Orentreich et al. |
| 4,057,251 | A | 11/1977 | Jones et al. |
| 4,072,553 | A | 2/1978 | Braker et al. |
| 4,203,240 | A | 5/1980 | Goodwin |
| 4,312,523 | A | 1/1982 | Haines |
| 4,318,683 | A | 3/1982 | Fishbaugh et al. |
| 4,381,615 | A | 5/1983 | Lonsmin |
| 4,405,045 | A | 9/1983 | Villa-Real |
| 4,473,429 | A | 9/1984 | Crankshaw |
| 4,505,497 | A | 3/1985 | Katzman |
| 4,518,450 | A | 5/1985 | Warmann |
| 4,533,586 | A | 8/1985 | Roule et al. |
| 4,567,681 | A | 2/1986 | Fumei |
| 4,589,943 | A | 5/1986 | Kimball et al. |
| 4,658,974 | A | 4/1987 | Fujita et al. |
| 4,680,080 | A | 7/1987 | Instance |
| 4,700,976 | A | 10/1987 | Loose |
| 4,724,973 | A | 2/1988 | Shah |
| 4,727,667 | A | 3/1988 | Ingle |
| 4,732,411 | A | 3/1988 | Siegel |
| 4,844,760 | A | 7/1989 | Dickey |
| 4,877,119 | A | 10/1989 | Hosking |
| 4,918,604 | A | 4/1990 | Baum |
| 4,920,912 | A | 5/1990 | Kirkling |
| 4,955,153 | A | 9/1990 | Albrecht et al. |
| D311,423 | S | 10/1990 | DeSantis |
| 5,017,261 | A | 5/1991 | Zodrow et al. |
| 5,048,870 | A | 9/1991 | Mangini et al. |
| 5,062,917 | A | 11/1991 | Zodrow |
| 5,076,613 | A | 12/1991 | Kovacs |
| 5,078,826 | A | 1/1992 | Rogall |
| 5,116,452 | A | 5/1992 | Eder |
| 5,154,448 | A | 10/1992 | Griffin et al. |
| 5,207,011 | A | 5/1993 | Coulthard |
| 5,209,367 | A | 5/1993 | Van Musscher et al. |
| 5,215,622 | A | 6/1993 | Schmelzer |
| 5,263,743 | A | 11/1993 | Jones |
| 5,264,265 | A | 11/1993 | Kaufmann |
| 5,269,085 | A | 12/1993 | Chiapetta et al. |
| 5,284,363 | A | 2/1994 | Gartner et al. |
| 5,321,933 | A | 6/1994 | Seifert et al. |
| 5,324,559 | A | 6/1994 | Brombacher |
| 5,339,998 | A | 8/1994 | Warren |
| 5,342,093 | A | 8/1994 | Weernink |
| 5,363,576 | A | 11/1994 | Piana et al. |
| 5,370,754 | A | 12/1994 | Soloman |
| 5,403,635 | A | 4/1995 | Hoffman |
| 5,403,636 | A | 4/1995 | Crum |
| 5,405,482 | A | 4/1995 | Morrissette et al. |
| 5,462,488 | A | 10/1995 | McKillip |
| 5,484,167 | A | 1/1996 | Donaldson et al. |
| D368,234 | S | 3/1996 | Dickinson et al. |
| 5,525,383 | A | 6/1996 | Witkowski |
| 5,605,230 | A | 2/1997 | Marino, Jr. et al. |
| 5,605,730 | A | 2/1997 | Treleaven |
| 5,639,529 | A | 6/1997 | Gozdecki et al. |
| D383,038 | S | 9/1997 | Willbrandt |
| D386,947 | S | 12/1997 | Lapierre et al. |
| 5,712,021 | A | 1/1998 | Hernandez |
| 5,727,766 | A | 3/1998 | Mayo |
| 5,727,819 | A | 3/1998 | Grosskopf et al. |
| 5,738,382 | A | 4/1998 | Grosskopf et al. |
| 5,741,381 | A | 4/1998 | Dolence et al. |
| 5,758,096 | A | 5/1998 | Barsky et al. |
| 5,799,525 | A | 9/1998 | Johnson et al. |
| 5,800,893 | A | 9/1998 | Harden |
| 5,809,674 | A | 9/1998 | Key |
| 5,829,789 | A | 11/1998 | Treleaven et al. |
| 5,830,550 | A | 11/1998 | Treleaven et al. |
| 5,842,633 | A | 12/1998 | Nurse |
| 5,863,628 | A | 1/1999 | Barry |
| 5,883,370 | A | 3/1999 | Walker et al. |
| 5,884,421 | A | 3/1999 | Key |
| 5,953,170 | A | 9/1999 | Glancy |
| 5,975,582 | A | 11/1999 | Treleaven |
| 6,027,780 | A | 2/2000 | Treleaven et al. |
| 6,035,568 | A | 3/2000 | Grosskopf et al. |
| 6,047,488 | A | 4/2000 | Tuszkiewicz |
| 6,048,423 | A | 4/2000 | Barrash et al. |
| 6,057,019 | A | 5/2000 | Barry |
| D428,307 | S | 7/2000 | Yeandel |
| 6,086,697 | A | 7/2000 | Key |
| 6,120,637 | A | 9/2000 | Barry |
| 6,129,802 | A | 10/2000 | Key |
| 6,129,959 | A | 10/2000 | Mercer et al. |
| 6,158,612 | A | 12/2000 | Alpert |
| D436,499 | S | 1/2001 | Pritchard et al. |
| 6,212,803 | B1 | 4/2001 | Key |
| 6,213,520 | B1 | 4/2001 | Treleaven et al. |
| 6,237,269 | B1 | 5/2001 | Key |
| 6,253,438 | B1 | 7/2001 | Jespersen |
| 6,254,138 | B1 | 7/2001 | Rawlings et al. |
| 6,258,200 | B1 | 7/2001 | Kassab |
| 6,267,672 | B1 | 7/2001 | Vance |
| D446,687 | S | 8/2001 | Furman et al. |
| 6,270,121 | B1 | 8/2001 | Dolan et al. |
| 6,274,236 | B1 | 8/2001 | Shacklett et al. |
| 6,276,533 | B1 | 8/2001 | Kaplan |
| 6,328,832 | B1 | 12/2001 | Otruba et al. |
| 6,329,034 | B1 | 12/2001 | Pendry et al. |
| 6,360,462 | B1 | 3/2002 | Mengel |
| 6,385,878 | B1 | 5/2002 | Key |
| 6,398,263 | B2 | 6/2002 | Treleaven et al. |
| 6,402,872 | B1 | 6/2002 | Key |
| 6,413,345 | B1 | 7/2002 | Treleaven |
| D461,369 | S | 8/2002 | Sims et al. |
| 6,428,639 | B1 | 8/2002 | Oldenburg et al. |
| 6,431,241 | B1 | 8/2002 | Gonzalo |
| 6,454,094 | B1 | 9/2002 | Salani |
| 6,550,171 | B1 | 4/2003 | De Werra et al. |
| 6,550,512 | B2 | 4/2003 | Yang |
| 6,561,246 | B2 | 5/2003 | Yang |
| 6,575,216 | B2 | 6/2003 | Yang |
| 6,581,773 | B2 | 6/2003 | Kaplan |
| 6,616,189 | B2 | 9/2003 | Raming |
| 6,622,878 | B1 | 9/2003 | Frey |
| 6,631,578 | B2 | 10/2003 | Key |
| 6,649,007 | B1 * | 11/2003 | Key ..... 156/215 |
| 6,669,804 | B2 | 12/2003 | Pendry et al. |
| 6,722,568 | B2 | 4/2004 | Blanford et al. |
| 6,737,137 | B2 | 5/2004 | Franko, Sr. et al. |
| 6,752,431 | B1 | 6/2004 | Matthews et al. |
| 6,755,442 | B2 | 6/2004 | Franko, Sr. et al. |

(56) References Cited

U.S. PATENT DOCUMENTS 6,779,480 B2 8/2004 Zamjahn
6,786,515 B2 9/2004 Franko, Sr.
6,793,075 B1 9/2004 Jeter
6,793,755 B2 9/2004 Schaupp et al.
6,811,640 B2 11/2004 Franko, Sr.
6,904,867 B2 6/2005 Zamjahn
7,010,877 B2 * 3/2006 Geary ..... 40/310
D526,847 S 8/2006 Freeman
7,087,298 B2 8/2006 Key
D527,583 S 9/2006 Freeman
D533,748 S 12/2006 Bresler
7,172,220 B2 2/2007 Franko, Sr.
7,172,668 B2 2/2007 Key
7,179,514 B2 2/2007 Olsen et al.
D545,429 S 6/2007 Hays
7,325,510 B2 2/2008 Giewercer
7,601,410 B2 10/2009 Matthews et al.
7,621,231 B2 11/2009 McNeely
7,628,427 B2 12/2009 Adler et al.
7,782,479 B2 8/2010 Handa et al.
7,875,142 B2 1/2011 Matthews et al.
7,886,909 B2 2/2011 Robinson
7,926,851 B2 4/2011 Kaufman
8,037,628 B2 10/2011 Kaufman
8,043,993 B2 10/2011 Roth et al.
D649,396 S 11/2011 Wilkens et al.
8,142,596 B1 3/2012 Valenti, Jr. et al.
8,245,752 B2 8/2012 Lingier et al.
8,272,562 B2 9/2012 Ziegler
8,413,884 B2 4/2013 Lim et al.
8,424,761 B2 4/2013 Yanagi
D682,088 S 5/2013 de Urquijo Carmona
8,479,919 B2 * 7/2013 Kaplan et al. ..... 40/310
8,709,198 B2 4/2014 Key
8,727,220 B2 5/2014 Key
D706,624 S 6/2014 Key
D706,625 S 6/2014 Key
8,814,217 B2 8/2014 Key
2001/0004152 A1 6/2001 Treleaven et al.
2001/0017181 A1 8/2001 Otruba et al.
2001/0025442 A1 10/2001 Key
2001/0045741 A1 11/2001 Shacklett et al.
2001/0050242 A1 12/2001 Kaplan
2002/0015813 A1 2/2002 Pendry et al.
2002/0017784 A1 2/2002 Merry et al.
2002/0029635 A1 3/2002 Kremen
2002/0038685 A1 4/2002 Key
2002/0096261 A1 7/2002 Yang
2002/0096262 A1 7/2002 Yang
2002/0096264 A1 7/2002 Yang
2002/0104613 A1 8/2002 Key
2002/0130182 A1 9/2002 Mondie
2002/0139292 A1 10/2002 Giewercer
2002/0185212 A1 12/2002 Schaupp et al.
2002/0193225 A1 12/2002 Raming
2003/0006606 A1 1/2003 Franko, Sr. et al.
2003/0012911 A1 1/2003 Campbell
2003/0015105 A1 1/2003 Dewig et al.
2003/0030270 A1 2/2003 Franko, Sr. et al.
2003/0091819 A1 5/2003 Franko, Sr.
2003/0118768 A1 6/2003 Sellars
2003/0137145 A1 7/2003 Fell et al.
2003/0175463 A1 9/2003 Olsen et al.
2003/0189490 A1 10/2003 Hogerton et al.
2003/0201064 A1 10/2003 Treleaven et al.
2004/0108237 A1 6/2004 McClintock
2004/0123565 A1 7/2004 Rice et al.
2004/0166277 A1 8/2004 Key
2004/0188998 A1 9/2004 Henthorn
2004/0197513 A1 10/2004 Shacklett et al.
2004/0207193 A1 10/2004 Franko, Sr.
2004/0247863 A1 12/2004 Scott
2005/0038558 A1 2/2005 Keene
2005/0056203 A1 3/2005 Giewercer
2005/0097004 A1 5/2005 Masse Blume
2005/0120600 A1 6/2005 Harman
2005/0181165 A1 8/2005 Franko
2005/0183982 A1 8/2005 Giewercer
2005/0190914 A1 9/2005 Chen et al.
2005/0209870 A1 9/2005 Alden
2006/0029761 A1 2/2006 Matthews et al.
2006/0032923 A1 2/2006 Krupa
2006/0078701 A1 4/2006 Glasier
2006/0145471 A1 7/2006 Franko
2006/0249950 A1 11/2006 Kenney et al.
2007/0029787 A1 2/2007 Loftin et al.
2007/0034103 A1 2/2007 Kaufman
2007/0043530 A1 2/2007 O'Rourke
2007/0119542 A1 5/2007 Williams et al.
2007/0209753 A1 9/2007 Gonzalez et al.
2007/0209755 A1 9/2007 Smith
2007/0213214 A1 9/2007 Roth et al.
2007/0221319 A1 9/2007 Morgan
2007/0222205 A1 9/2007 Handa et al.
2007/0252379 A1 11/2007 Bethune et al.
2007/0299693 A1 12/2007 Jung et al.
2008/0003391 A1 1/2008 Franko et al.
2008/0003410 A1 1/2008 Shacklett et al.
2008/0010874 A1 1/2008 Londino
2008/0014344 A1 1/2008 Fort et al.
2008/0073902 A1 3/2008 Franko
2008/0121688 A1 5/2008 Harrop
2008/0176955 A1 7/2008 Heck et al.
2008/0208694 A1 8/2008 Baggott
2008/0233405 A1 9/2008 Dronzek Jr.
2008/0303264 A1 12/2008 Kaufman
2008/0303265 A1 12/2008 Kaufman
2009/0236023 A1 9/2009 Lingier et al.
2009/0255623 A1 10/2009 Bagung et al.
2009/0264815 A1 10/2009 Grogan, Jr.
2009/0265188 A1 10/2009 Lamy et al.
2009/0294521 A1 12/2009 de la Huerga
2010/0043267 A1 2/2010 Sterling
2010/0044438 A1 2/2010 Chen et al.
2010/0084077 A1 4/2010 Matthews et al.
2010/0101681 A1 4/2010 Kramer et al.
2010/0228615 A1 9/2010 Hays
2010/0240133 A1 9/2010 Brivanlou et al.
2010/0295916 A1 11/2010 Kaufman
2010/0300599 A1 12/2010 Fort et al.
2010/0307947 A1 12/2010 Marden et al.
2011/0061802 A1 3/2011 Raming
2011/0151115 A1 6/2011 Lingier
2011/0169602 A1 7/2011 Gaffney
2011/0185606 A1 8/2011 Londino
2011/0233095 A1 9/2011 Seidl
2012/0006712 A1 1/2012 Kaplan et al.
2012/0010299 A1 1/2012 Kaplan et al.
2012/0037299 A1 2/2012 Baeta et al.
2012/0085828 A1 4/2012 Ziegler
2012/0118503 A1 5/2012 Lorence et al.
2012/0125526 A1 5/2012 Key
2012/0175336 A1 7/2012 Miller et al.
2012/0268837 A1 10/2012 Rittenburg et al.
2012/0279632 A1 11/2012 Lingier et al.
2012/0292219 A1 11/2012 Terwilliger et al.
2013/0025175 A1 1/2013 Key
2013/0025529 A1 1/2013 Key
2013/0026056 A1 1/2013 Key
2013/0026747 A1 1/2013 Key
2013/0033031 A1 2/2013 Key
2013/0036634 A1 2/2013 Key
2013/0036641 A1 2/2013 Key
2013/0037619 A1 2/2013 Key
2013/0043157 A1 2/2013 Key
2013/0062239 A1 3/2013 Key
2013/0129971 A1 5/2013 Key et al.
2014/0076766 A1 3/2014 Key

(56) References Cited

U.S. PATENT DOCUMENTS

| | | | |
|---|---|---|---|
| 2014/0210198 | A1 | 7/2014 | Key |
| 2014/0224889 | A1 | 8/2014 | Key |
| 2014/0339120 | A1 | 11/2014 | Key |

FOREIGN PATENT DOCUMENTS

| | | |
|---|---|---|
| AU | 723118 | 11/2000 |
| BE | 932891 | 4/2002 |
| BE | 1165378 | 9/2004 |
| CH | 932891 | 4/2002 |
| CH | 1165378 | 9/2004 |
| CN | 103890826 | 6/2014 |
| DE | 69711903.3-08 | 4/2002 |
| DE | 1165378 | 9/2004 |
| DK | 85214 | 3/1958 |
| DK | 932891 | 4/2002 |
| EP | 285514 | 10/1988 |
| EP | 932891 | 4/2002 |
| EP | 1165378 | 9/2004 |
| EP | 2742501 | 6/2014 |
| ES | 932891 | 4/2002 |
| FR | 965522 | 9/1950 |
| FR | 1114750 | 4/1956 |
| FR | 1347102 | 11/1963 |
| FR | 2460260 | 1/1981 |
| FR | 285514 | 10/1988 |
| FR | 2613519 | 10/1988 |
| FR | 2677786 | 12/1992 |
| FR | 932891 | 4/2002 |
| FR | 1165378 | 9/2004 |
| GB | 932891 | 4/2002 |
| HK | 1039770 | 5/2002 |
| HK | 1021056 | 7/2002 |
| IE | 932891 | 4/2002 |
| IE | 1165378 | 9/2004 |
| IT | 327286 | 7/1935 |
| IT | 932891 | 4/2002 |
| MX | 204456 | 9/2002 |
| MX | 225535 | 1/2005 |
| MX | 227727 | 5/2005 |
| NL | 932891 | 4/2002 |
| NZ | 334683 | 11/1999 |
| SE | 1565 | 7/1888 |
| SE | 932891 | 4/2002 |
| WO | WO98/19289 | 5/1998 |
| WO | WO00/48161 | 8/2000 |
| WO | WO03017174 | 2/2003 |
| WO | WO2007020628 | 2/2007 |
| WO | WO2012071355 | 5/2012 |
| WO | WO2013015838 | 1/2013 |
| WO | WO2013015839 | 1/2013 |
| WO | WO2013016364 | 1/2013 |
| WO | WO2013016461 | 1/2013 |
| WO | WO2013019907 | 2/2013 |
| WO | WO2013022495 | 2/2013 |
| WO | WO2013022508 | 2/2013 |
| WO | WO2013023221 | 2/2013 |
| WO | WO2013025947 | 2/2013 |
| WO | WO2013039578 | 3/2013 |
| WO | WO2013043618 | 3/2013 |
| WO | WO2014047077 | 3/2014 |

OTHER PUBLICATIONS

International Search Report and Written Opinion mailed Oct. 9, 2012 in Patent Cooperation Treaty Application No. PCT/US2012/048021, filed Jul. 24, 2012.

International Search Report and Written Opinion mailed Oct. 23, 2012 in Patent Cooperation Treaty Application No. PCT/US2012/050643, filed Aug. 13, 2012.

International Search Report and Written Opinion mailed Nov. 30, 2012 in Patent Cooperation Treaty Application No. PCT/US2012/055948, filed Sep. 18, 2012.

International Search Report and Written Opinion mailed Jul. 26, 2012 in Patent Cooperation Treaty Application No. PCT/US2012/037395, filed May 10, 2012.

International Search Report and Written Opinion mailed Oct. 16, 2012 in Patent Cooperation Treaty Application No. PCT/US2012/048201, filed Jul. 25, 2012.

International Search Report and Written Opinion mailed Jul. 9, 2012 in Patent Cooperation Treaty Application No. PCT/US2012/031670, filed Mar. 30, 2012.

International Search Report and Written Opinion mailed Oct. 23, 2012 in Patent Cooperation Treaty Application No. PCT/US2012/051228, filed Aug. 16, 2012.

International Search Report and Written Opinion mailed Oct. 16, 2012 in Patent Cooperation Treaty Application No. PCT/US2012/049234, filed Aug. 1, 2012.

International Search Report and Written Opinion mailed Aug. 27, 2012 in Patent Cooperation Treaty Application No. PCT/US2012/040301, filed May 31, 2012.

Newswire, "AccuDial(R) Pharmaceutical, Inc. can put an end to underdosing and overdosing with new line of children's over-the-counter medications", Jul. 8, 2010 [retrieved Dec. 12, 2013]. Retrieved from Internet: <http://www.newswire.ca/en/story/646945/accudial-r-pharmaceutical-inc-can-put-an-end-to-underdosing-and-overdosing-with-new-line-of-children-s-over-the-counter-medications>.

Accudial Pharmaceutical, Inc. company website, www.accuratedose.com, Oct. 30, 2010 [retrieved Aug. 7, 2012). Retrieved from Internet: <http://web.archive.org/web/20101030115353/http://www.accuratedose.com.ca_english/home>.

Anonymous, "Chest congestion (guaifenesin) liquid", Internet article, http://dailymed.nlm.nih.gov/dailymed/druginfo.cfm?id=25295., (Oct. 26, 2009).

Anonymous, "Pharmaceutical & medical packaging news", The packaging magazine for the healthcare industry, 16:12:76-78, Internet article, http://www.accuratedose.com/corporate/assets/pdf/PMP_MagReprinIDec08.pdf, (Dec. 12, 2008).

A. Abramson, "Start-up has twist on safe doses for kids", Internet article, http://www.accuratedose.com/corporate/assets/pdf/50840_ACC_PBP_Article. pdf, (Jul. 27, 2009).

Anonymous, "Chest congestion guaifenesin oral solution expectorant", Internet article, http://accuratedose.com/us_english/producUnformation/chest_congestion.html, (Aug. 24, 2011).

International Search Report and Written Opinion mailed Apr. 2, 2012 in Patent Cooperation Treaty Application No. PCT/US2011/061739, filed Nov. 21, 2011.

International Search Report and Written Opinion mailed Feb. 28, 2014 in Patent Cooperation Treaty Application No. PCT/US2013/060220, filed Sep. 17, 2013.

* cited by examiner

MEDICAL INFORMATION ROTATING LABEL SYSTEM FOR A CONTAINER

CROSS-REFERENCE TO RELATED APPLICATIONS

The present application claims priority to provisional U.S. Patent Application Ser. No. 61/524,254, filed on Aug. 16, 2011, titled "Method and Device for Illustrating a Medical Condition and the Results from Taking the Medication Within the Packaging," which is hereby incorporated by reference in its entirety.

FIELD OF THE INVENTION

The present application is directed generally to labels, and more specifically to labels for consumer product containers that illustrate medical information related to medication in the container.

BACKGROUND

Containers for consumer products have a limited amount of outer surface area for placement of labels on the container. This may pose a challenge to manufacturers of these consumer products to fit all of the information they want to deliver to the consumer, or are required by law to deliver to the consumer, in this limited area. In particular, packaging for prescription medications may specify a significant amount of information concerning the condition the medication is intended to treat, as well as the effects of consuming the medication.

Manufacturers of pharmaceuticals and other medical-related packaged products spend millions of dollars each year explaining to consumers how their medication may provide relief for medical conditions. The means of delivery of this information, such as television advertisements, print advertisements, and additional on-package print material, can be very costly and serve to increase the cost of the medication to the consumer. All this effort may ultimately go to waste if the consumer does not take the initiative to seek out and read the information.

Health care professionals often inform patients of medical conditions and the importance of taking prescribed medications using charts and other visual aids. Visual aids may be easier to comprehend and lend themselves to be more readily remembered. However, over time patient may tend to forget the information presented on the visual aid because there is no reinforcement of the information after the patient leaves the office of the health care provider.

SUMMARY

The present application is directed to rotating label medical information systems for a container. An exemplary illustrative rotating label medical information system may comprise a base label adhered to the container. The base label may have a back surface and a front surface, with at least a first and second item of medical information printed on the front surface. The rotating label medical information system may further comprise an opaque rotating top label covering at least a portion of the front surface of the base label. The opaque rotating top label may be rotatable about the base label. In various embodiments, the opaque rotating top label may have a first transparent window and a second transparent window placed within separate portions of the top label allowing at least the first and second items of medical information to be visible through the first transparent window and the second transparent window.

According to additional exemplary embodiments, the present application may be directed to methods for communicating medical information associated with a container. An exemplary method may comprise adhering a base label having a back surface and a front surface to the container, with at least a first and second item of medical information placed on the front surface of the base label. At least a portion of the front surface of the base label may be covered by an opaque rotating top label. A first transparent window and a second transparent window may be placed within separate portions of the opaque rotating top label, such that at least the first and the second items of medical information may be visible through the first transparent window and the second transparent window.

DETAILED DESCRIPTION

The present application is directed to rotating label medical information systems for a container. An exemplary illustrative rotating label medical information system may comprise a base label adhered to the container. The base label may have a back surface and a front surface, with at least a first and second item of medical information printed on the front surface. The rotating label medical information system may further comprise an opaque rotating top label covering at least a portion of the front surface of the base label. The opaque rotating top label may be rotatable about the base label. In various embodiments, the opaque rotating top label may have a first transparent window and a second transparent window allowing at least the first and second items of medical information to be visible through the first transparent window and the second transparent window.

Figure 1:
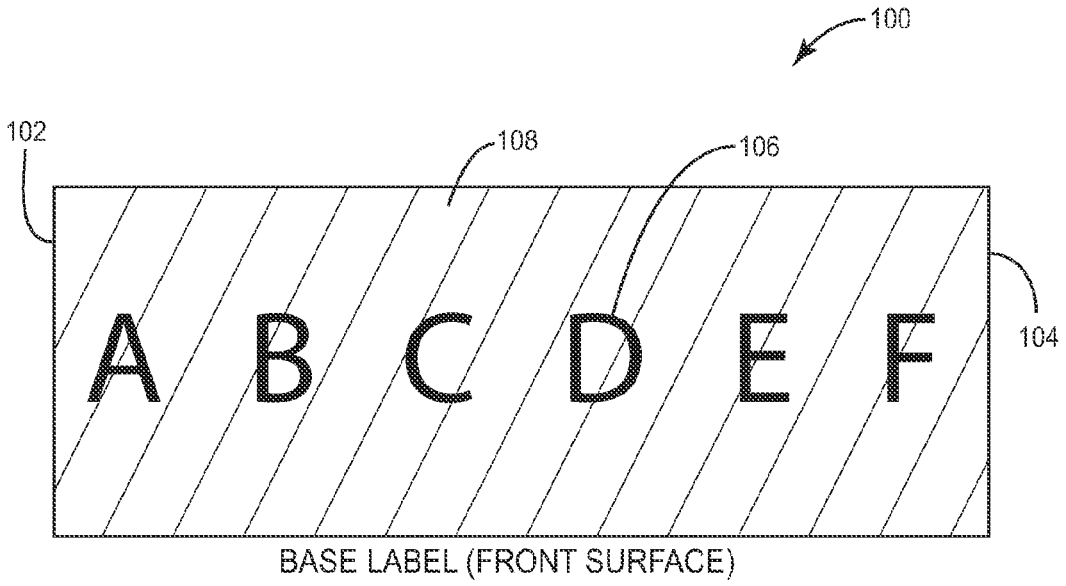
FIG. 1 is a front view of an exemplary label according to various embodiments.

FIG. 1 illustrates various embodiments of a front surface 108 of a base label 100 for an object, such as a medication container, according to various embodiments. The base label 100 comprises a leading edge 102 and a trailing edge 104. While the leading edge 102 is oriented to the left and the trailing edge is oriented to the right as presented in FIG. 1, the orientation of the leading edge 102 and the trailing edge 104 could be reversed depending on which edge is first applied to the object. Both orientations are within the scope of the present disclosure. Base label front surface 108 may comprise writing or other base label indicia 106 thereon.

As used herein, the leading edge refers to the first edge to be affixed to the object and the trailing edge refers to the second edge to be affixed to the object or the overlapping leading edge. Depending on the orientation of the label and the object when the label is affixed to the object, either edge of the label may be the leading edge. The orientations presented in the figures are for convenience and are not intended to be limiting in any way.

Figure 2:
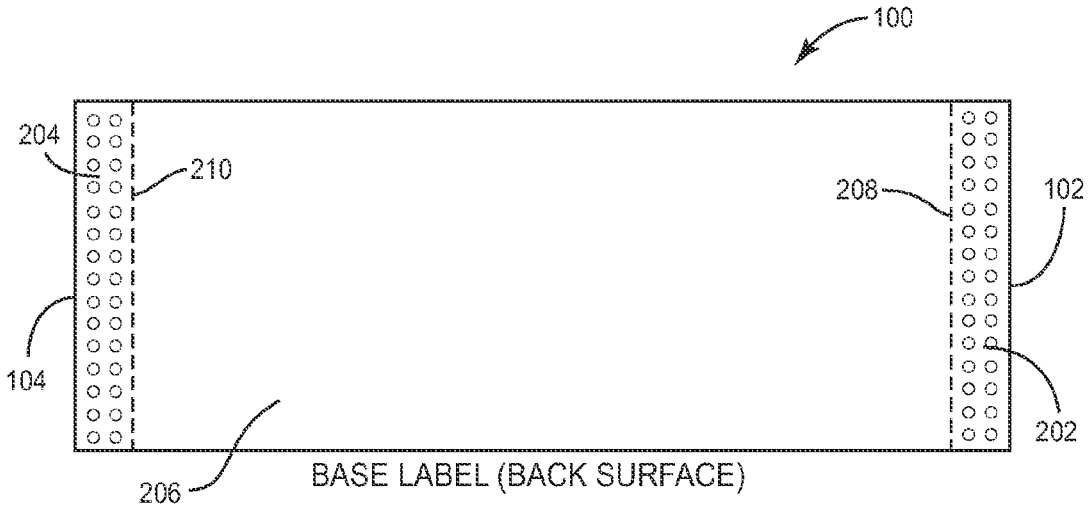
FIG. 2 is a back view of an exemplary label according to various embodiments.

FIG. 2 illustrates various embodiments of a back surface 206 of the base label 100. In various embodiments, the base label back surface 206 comprises two strips of adhesive 202 and 204 on or immediately adjacent to the leading and trailing edges, 102 and 104, respectively. Base label leading edge adhesive 202 may have a boundary 208 defined as its limit on the base label back surface 206. Base label trailing edge adhesive 204 may also have a boundary 210. While FIG. 2 illustrates that the adhesive strips 202 and 204 are generally close to the base label leading and trailing edges 102 and 104, respectively, it is understood that the adhesive strips 202 and 204 may be continuous or discontinuous, and may extend across any portion of the base label back surface 206, including the entire base label back surface 206. In various embodiments, a length of the base label 100 may be selected to be slightly longer than a circumference of the object on which it is placed, such that the trailing edge 104 overlaps the leading edge 102, and the trailing edge 104 is affixed to the leading edge 102. In various embodiments, the length of the base label 100 may be selected to be approximately the same as the circumference of the object on which it is placed, such that the leading edge 102 and the trailing edge 104 do not overlap.

Figure 3:
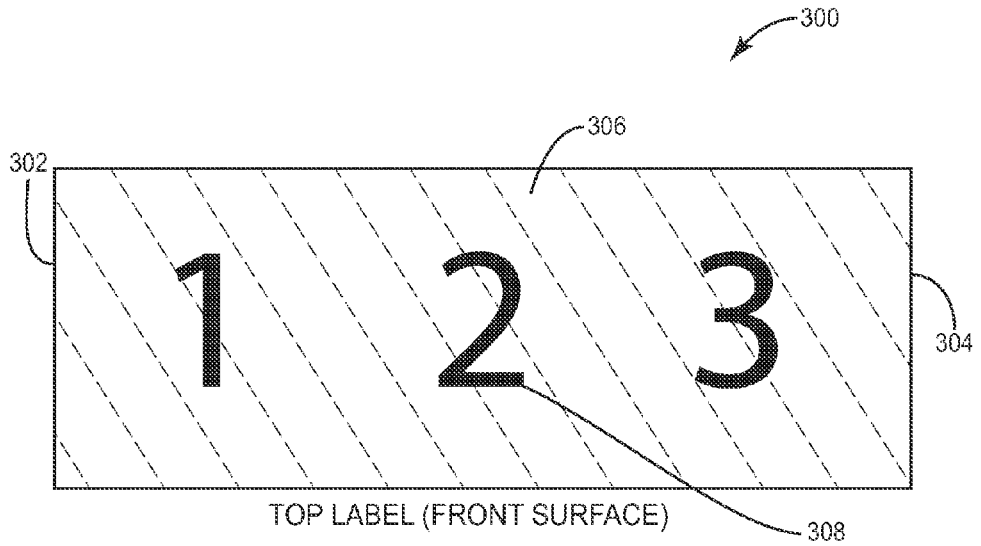
FIG. 3 is a front view of an exemplary label according to various embodiments.

FIG. 3 illustrates various embodiments of a top label front surface 306 of a top label 300. Top label 300 comprises a leading edge 302 and a trailing edge 304, and indicia 308 may be imprinted on the top label front surface 306.

Figure 4:
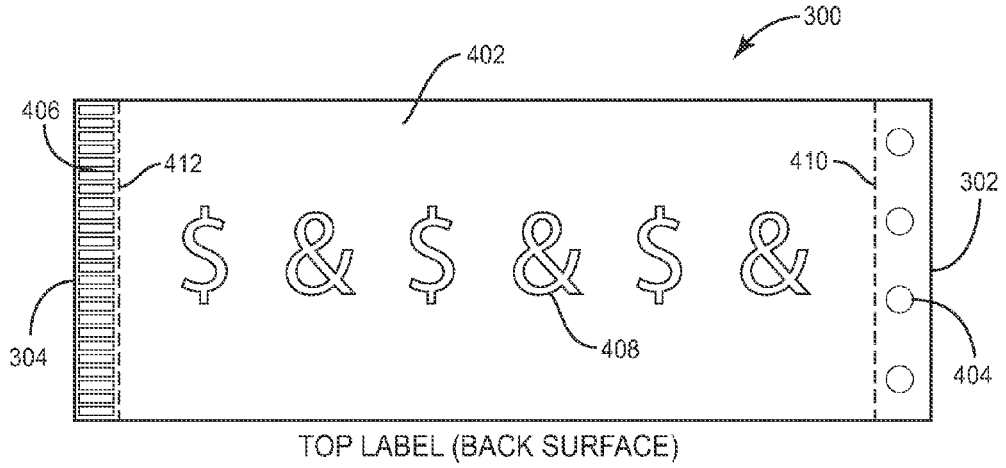
FIG. 4 is a back view of an exemplary label according to various embodiments.

Various embodiments of a back surface 402 of the top label 300 are illustrated in FIG. 4. The top label back surface 402 may comprise various indicia 408 printed thereon, as well as two strips of adhesive 404 and 406 on or immediately adjacent to the leading and trailing edges, 302 and 304, respectively. Top label leading edge adhesive 404 may have a boundary 410 defined as its limit on the top label back surface 402. Top label trailing edge adhesive 406 may also have a boundary 412. While FIG. 4 illustrates that the adhesive strips 404 and 406 are generally close to the top label leading and trailing edges 302 and 304, respectively, it is understood that the adhesive strips 404 and 406 may be continuous or discontinuous, and may extend across any portion of the top label back surface 402, including the entire top label back surface 402. In various embodiments, the adhesive strips 404 and 406 are confined to areas near the leading and trailing edges 302 and 304, respectively, so as not to obscure or interfere with the top label back surface indicia 408.

The base label adhesive 202, 204 and the top label adhesive 404, 406 may be applied in a variety of patterns as can be appreciated by one skilled in the art. The adhesive 202, 204, 404, 406 may be applied in in strips, dots, droplets, circles, rectangles, squares, triangles, lines, and the like, as well as combinations of patterns.

A length of the top label 300 may be selected to be slightly longer than a circumference of the object on which it is placed, such that the top label trailing edge 304 overlaps the top label leading edge 302, and the top label trailing edge 304 is affixed to the top label leading edge 302. In various embodiments, the length of the top label 300 may be selected to be approximately the same as the circumference of the object on which it is placed, such that both the leading edge 302 and the trailing edge 304 do not overlap and are affixed to the base label front surface 108.

Figure 5A:
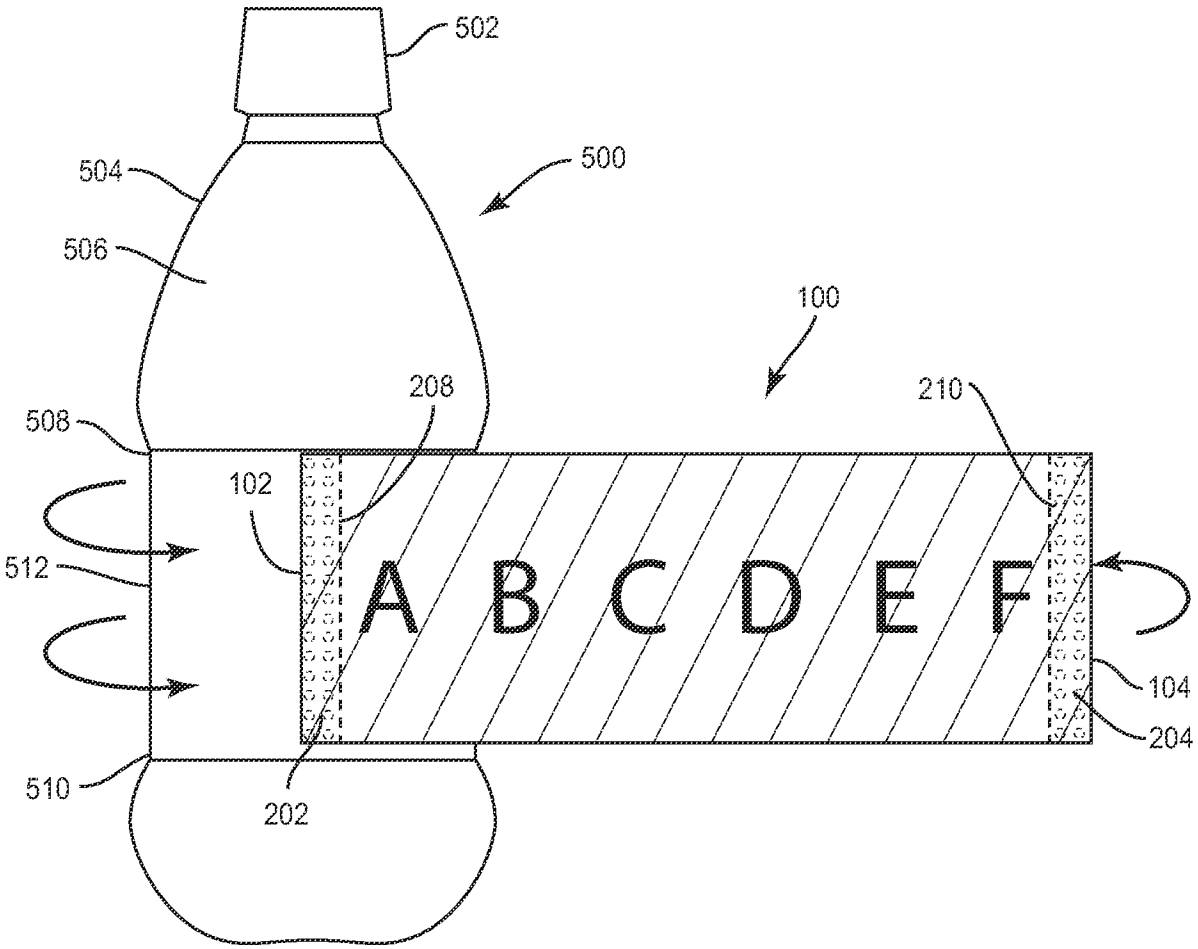
FIG. 5A illustrates a leading edge of an exemplary label affixed to a container according to various embodiments.

FIG. 5A illustrates the application of the base label 100 to an exemplary container 500 according to various embodiments. The container 500 may be a glass or plastic bottle, or other type of container such as a metal can or a cardboard receptacle. The container may be round, rectangular, square, or any other shape known in the art. The term "container" is used here for convenience to describe exemplary embodiments. It is understood that the container may be any object, including non-containers. Container 500 may comprise a cap 502 removably secured to a body 504. Various embodiments of the body 504 may have an exterior surface 506 that comprises a upper label panel 508, a lower label panel 510, and a recessed surface 512 interposed between the upper label panel 508 and the lower label panel 510. As discussed below, the base label 100 may be applied to the container 500 at the recessed surface 512 between the upper label panel 508 and the lower label panel 510.

In various embodiments, the top label 300 may be rotatable about the base label 100, as discussed below. In these embodiments, the upper label panel 508 and lower label panel 510 may function to restrict upward and downward movement of the top label 300 in relation to the container 500 such that the top label 300 generally remains in a position covering at least a portion of the base label 100.

Figure 5B:
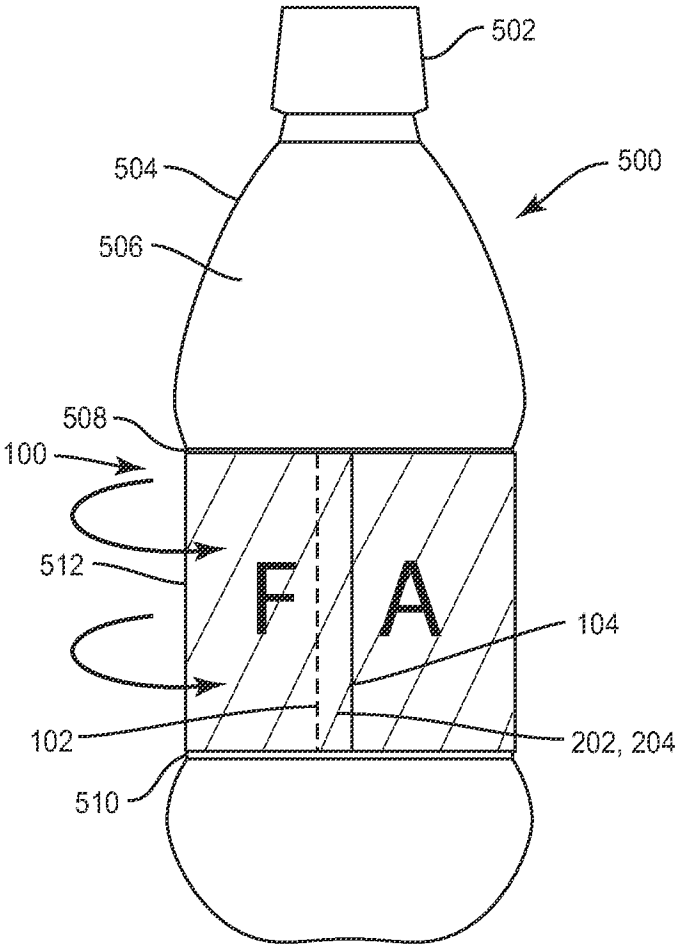
FIG. 5B illustrates an exemplary label secured about a container according to various embodiments.

FIG. 5B illustrates the container 500 with the base label 100 affixed to the container 500. Initially, as illustrated in FIG. 5A, base label leading edge 102 is placed in contact with the recessed surface 512 of the container 500 and affixed to the container 500 by the leading edge adhesive strip 202. With relative motion between the container 500 and the base label 100, the base label 100 may be wrapped around the container 500 with the base label trailing edge 104 now overlapping the base label leading edge 102 such that the leading edge adhesive strip 202 holds the base label leading edge 102 to the container 500 while the trailing edge adhesive strip 204 holds the base label trailing edge 104 to the overlapped base label leading edge 102.

Figure 6:
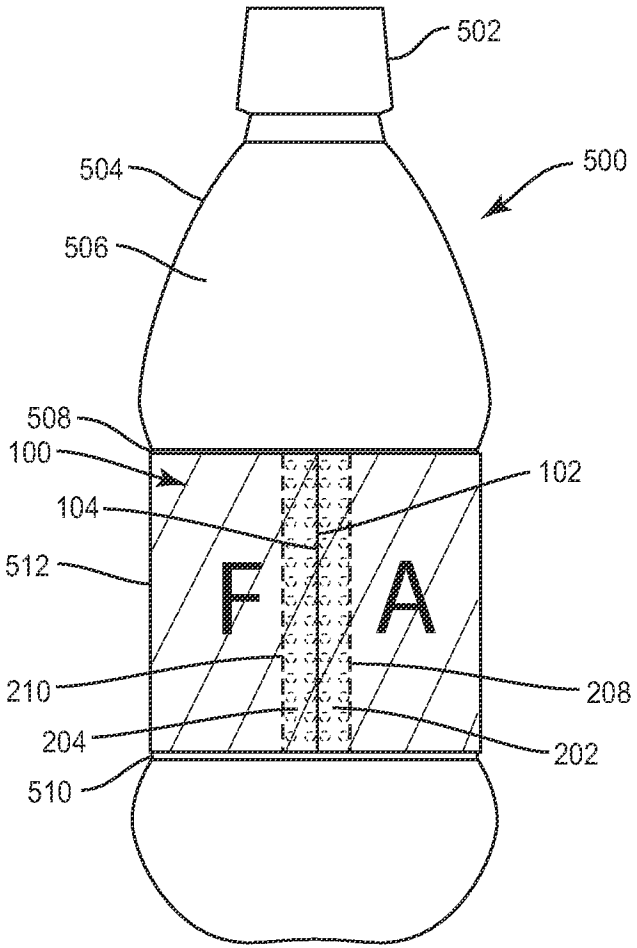
FIG. 6 illustrates an exemplary label secured about a container according to various embodiments.
Figure 7:
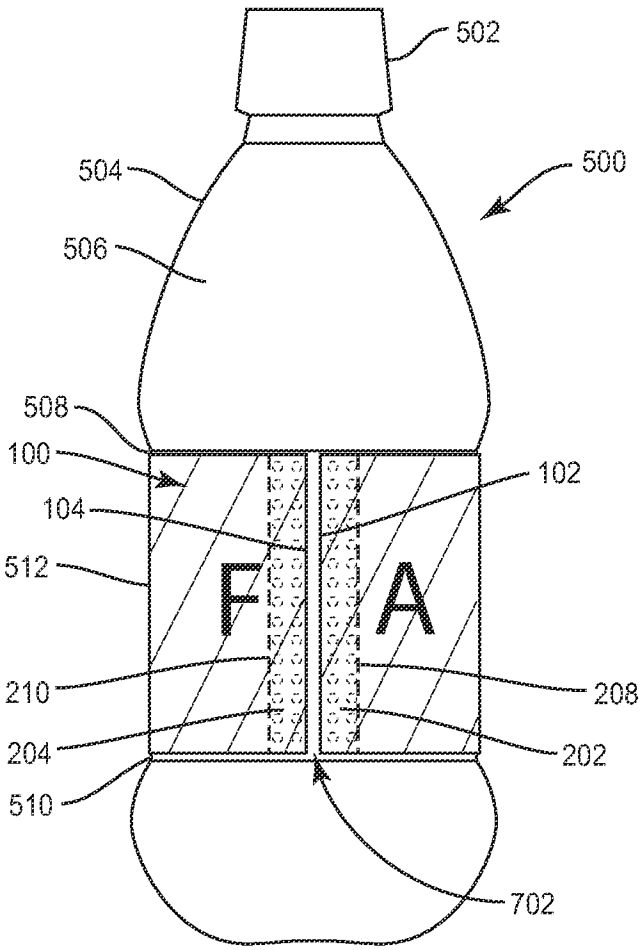
FIG. 7 illustrates an exemplary base label secured about a container according to various embodiments.

In various embodiments as illustrated in FIG. 6, the length of the base label 100 may be substantially the same as a circumference of the recessed surface 512 of the container 500, which may allow the base label leading edge 102 and base label trailing edge 104 to abut rather than overlap. However, it is also possible that the length of the base label 100 may be shorter than the circumference of the recessed surface 512, resulting in a gap 702 between the base label leading edge 102 and the base label trailing edge 104 when the base label 100 is affixed to the recessed surface as illustrated in FIG. 7. In both of these instances, the base label trailing edge adhesive strip 204 may adhere to the recessed surface 512 of the container 500, rather than the base label leading edge 102.

In various embodiments, the base label adhesive strips 202, 204 may comprise a permanent adhesive. In general, a permanent adhesive is one that does not readily release from a surface to which it adheres after the adhesive dries or cures. Using the base label 100 as an example, the permanent adhesive 202, 204 will tend not to release from the recessed surface 512, nor will it tend to release the base label leading edge 102 or trailing edge 104 once dried or cured. In order to remove the base label from the recessed surface 512, the base label 100 may have to be torn from the adhesive, or the adhesive layer 202, 204 may have to be fractured which may leave some of the adhesive on the recessed surface 512 and some of the adhesive on the base label leading edge 102 or trailing edge 104. Once the surfaces affixed with the permanent adhesive are separated, they may not be reattached.

Figure 8:
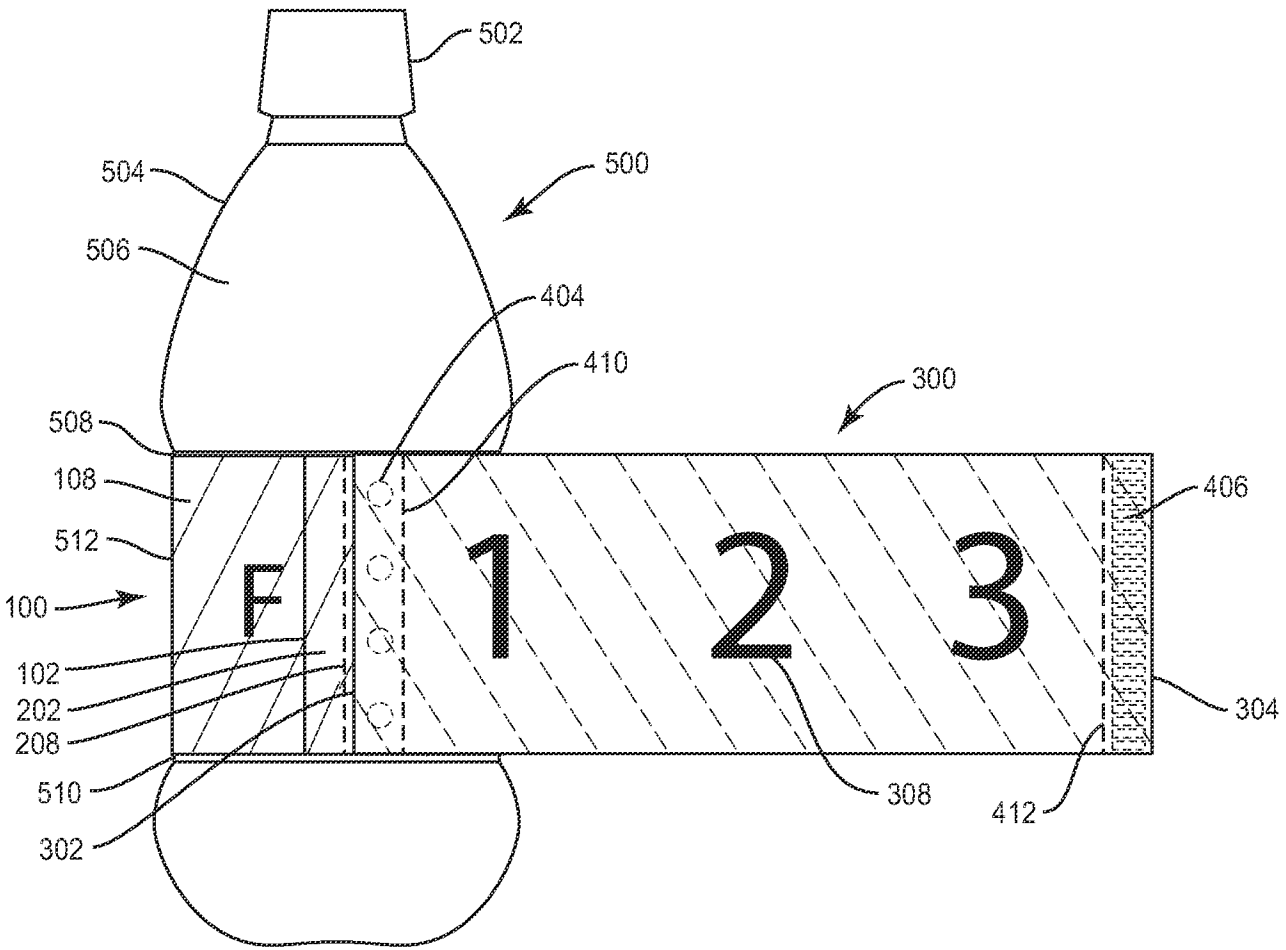
FIG. 8 illustrates a leading edge of an exemplary top label affixed to an exemplary base label according to various embodiments.

In FIG. 8, the base label 100 is already affixed to the recessed surface 512 of the container 500, and the application of the top label 300 over the base label 100 is illustrated according to various embodiments. The top label leading edge 302 may be placed in contact with any portion of the base label front surface 108 and affixed to the base label front surface 108 by the top label leading edge adhesive strip 404. With relative motion between the container 500 and the top label 300, the top label 300 may be wrapped around the container 500 with the top label trailing edge 304 now overlapping the top label leading edge 302 such that the top label leading edge adhesive strip 404 holds the top label leading edge 302 to the base label 100 while the top label trailing edge adhesive strip 406 holds the top label trailing edge 304 to the overlapped top label leading edge 302.

Figure 9:
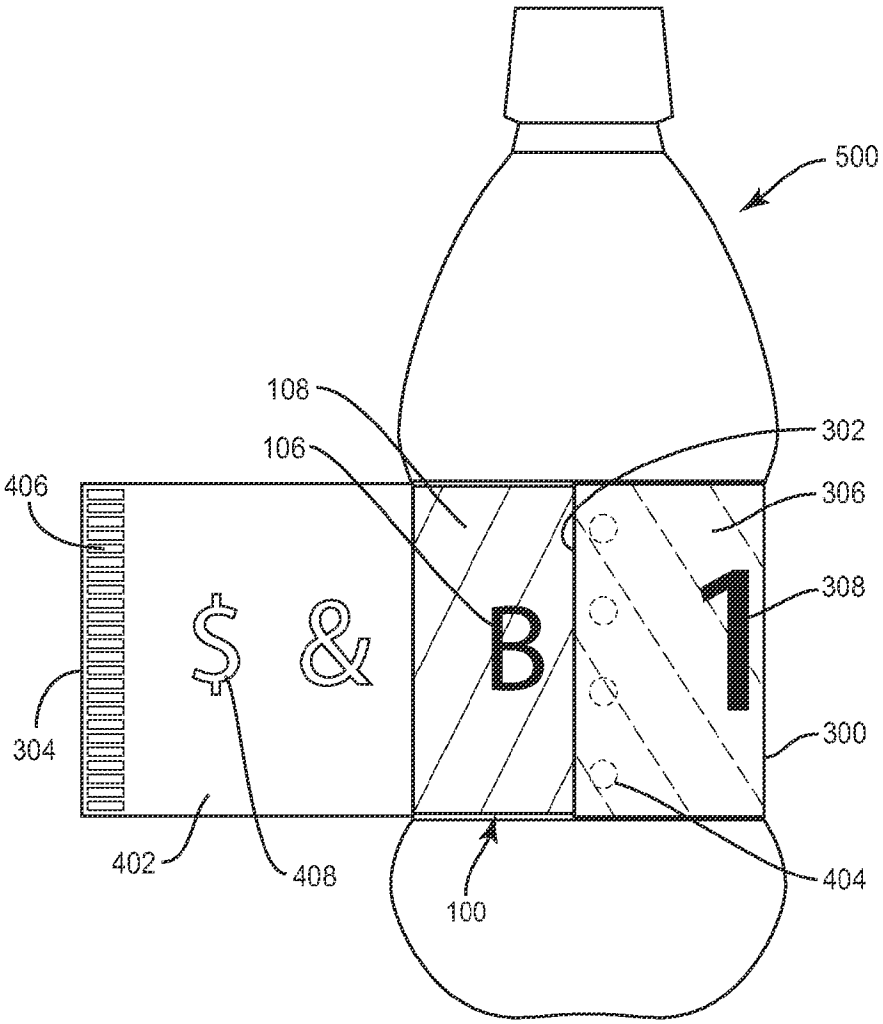
FIG. 9 illustrates an exemplary top label affixed to an exemplary base label and partially wrapped about a container according to various embodiments.

FIG. 9 illustrates the operation of the base label 100 and the top label 300 according to various embodiments. Beginning with the container 500 with the base label 100 and the top label 300 in place as shown, for example, in FIG. 6, the top label trailing edge 304 may be detached from the top label leading edge 302 and at least partially peeled back as shown in FIG. 9. The combination of the base label 100 and the top label 300 in this configuration increases the amount of surface area available for viewing by a consumer or user of the container 500. Prior to detaching the top label trailing edge 304, the consumer may view the top label front surface 306. Upon detaching the top label trailing edge 304, the consumer may now view the top label back surface 402 and the base label front surface 108 in addition to the top label front surface 306.

One of at least three types of adhesive may be used for the top label leading edge adhesive 404. A first type of adhesive is the permanent adhesive as described above for the base label 100. When a permanent adhesive is used for the top label leading edge adhesive 404, the top label leading edge generally cannot be detached without inflicting damage to one or both of the top label 300 or the base label 100. This may be desirable for various embodiments where the top label 300 is not intended to be removed from the container 500.

A second type of adhesive that may be used for the top label leading edge adhesive 404 is a releasable adhesive. A releasable adhesive is one that will release from a surface to which it is attached once a sufficient mechanical force is applied. A releasable adhesive may be used, for example, when the top label back surface 402 comprises a coupon for a subsequent purchase of a product. The releasable adhesive may allow the consumer to easily remove the top label 300 for later use. In various embodiments, the releasable adhesive may be a breakaway adhesive. A breakaway adhesive may have limited ability to withstand shear stresses. Shear stresses may cause the adhesive bond created between the label (e.g., top label 300) and the surface to which it is affixed (e.g., the base label 100 or container 500) to fail along the adhesive. In general, a releasable or breakaway adhesive may not re-attach to a surface once removed.

A third type of adhesive that may be used for the top label leading edge adhesive 404 is a resealable adhesive. A resealable adhesive may release from a surface to which it is attached once a sufficient mechanical force is applied, similar to the releasable adhesive described above. However, the resealable adhesive may be re-attached to a surface by applying pressure. A resealable adhesive may be desirable when the top label back surface 402 or the base label front surface 108 comprise information that may be needed only on occasion. Thus, the consumer or user may detach the top label 300 when the information is needed, then re-attach the top label 300.

In various embodiments, the top label trailing edge adhesive 406 may be a releasable adhesive or a resealable adhesive, depending on the intended use of the top label 300. As described above, if the surfaces 108, 402 comprise information that is intended to stay with the container, the top label trailing edge adhesive 406 may be a resealable adhesive. In contrast, if the top label 300 is intended to be removed from the container 500, a releasable adhesive may be desirable.

Figure 10:
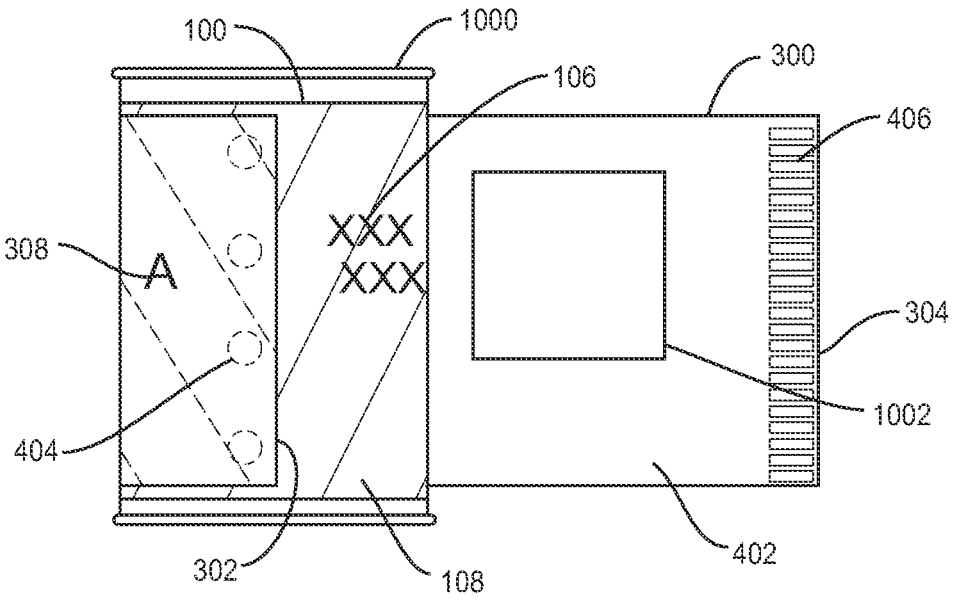
FIG. 10 illustrates an exemplary top label with a window affixed to an exemplary base label and partially wrapped about a container according to various embodiments.

FIG. 10 illustrates various embodiments of the top label 300 comprising a window 1002. The window 1002 may comprise a void in the top label 300 such that a portion of the base label 100 may be visible through the window. In various embodiments, the window 1002 may have a transparent covering (not shown). In various other embodiments, the window may comprise a transparent section of the top label 300 itself rather than a void. FIG. 10 illustrates the top label 300 partially wrapped about a container 1000, and base label 100 already in place on the container 1000. As shown, the top label leading edge adhesive 404 maintains the top label 300 coupled to the base label 100. The top label 300 may then be moved from the position illustrated in FIG. 10 to the position illustrated in FIG. 11 to secure the top label 300 about the container 1000. Top label trailing edge adhesive 406 may couple to the top label leading edge 302 if the top label leading edge 302 and trailing edge 304 overlap; otherwise, the top label trailing edge adhesive 406 may be coupled to the base label front surface 108.

Figure 11:
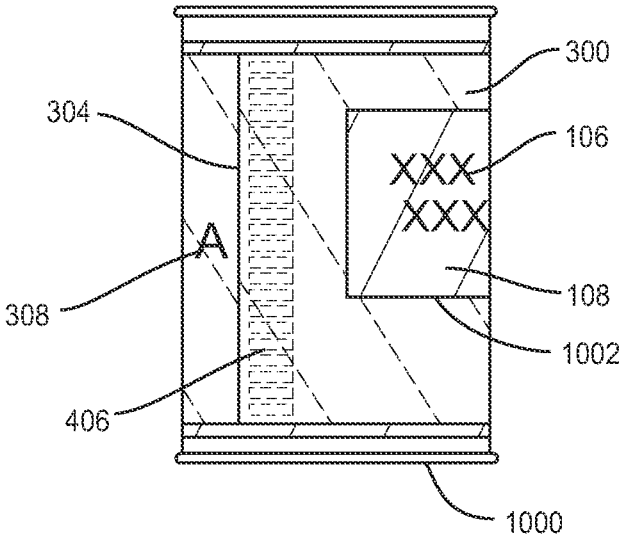
FIG. 11 illustrates an exemplary top label with a window secured about a container and a portion of a base label visible through the window according to various embodiments.

Once the top label 300 is in position on the container 1000 as illustrated in FIG. 11, at least a portion of the base label indicia 106 may be visible through the window 1002. This may allow viewing of a first portion of the base label 100 without removing the top label 300. In various embodiments, the top label leading edge adhesive 404 may be a breakaway adhesive. Rotation of the top label 300 relative to the base label 100 may exert shear stresses on the breakaway adhesive, causing the adhesive bond affixing the top label leading edge 302 to the base label 100 to fail. The top label 300 may then be freely rotatable about the base label 100, and a second portion of the base label 100 may be visible when the top label 300 is rotated to a second position. The window 1002 may be rectangular as illustrated in FIGS. 10 and 11, or any other shape as needed for a particular application. For example, the window 1002 may be a slit that reveals an alphanumeric string on the base label 100. In various embodiments, the top label 300 may comprise more than one window 1002. Various embodiments in which the top label trailing edge adhesive 406 is a resealable or releasable adhesive may allow the top label 300 to be peeled back to reveal the top label back surface 402 and essentially the entire base label front surface 108 or to be removed from the container 1000, in addition to being rotatable.

One skilled in the art will readily recognize that labels may be applied to containers using a variety of methods and that there may be a variety of single-label and multi-label systems other than those described above. Any such application methods or label systems may be used with the present disclosure. The above descriptions are exemplary and not to be construed as limiting in any way. Examples of other application methods and label systems may be disclosed in U.S. Pat. Nos. 5,884,421, 6,086,697, 6,237,269, 6,402,872, 6,631,578, 6,649,007, 7,087,298, and 7,172,668.

Figure 12:
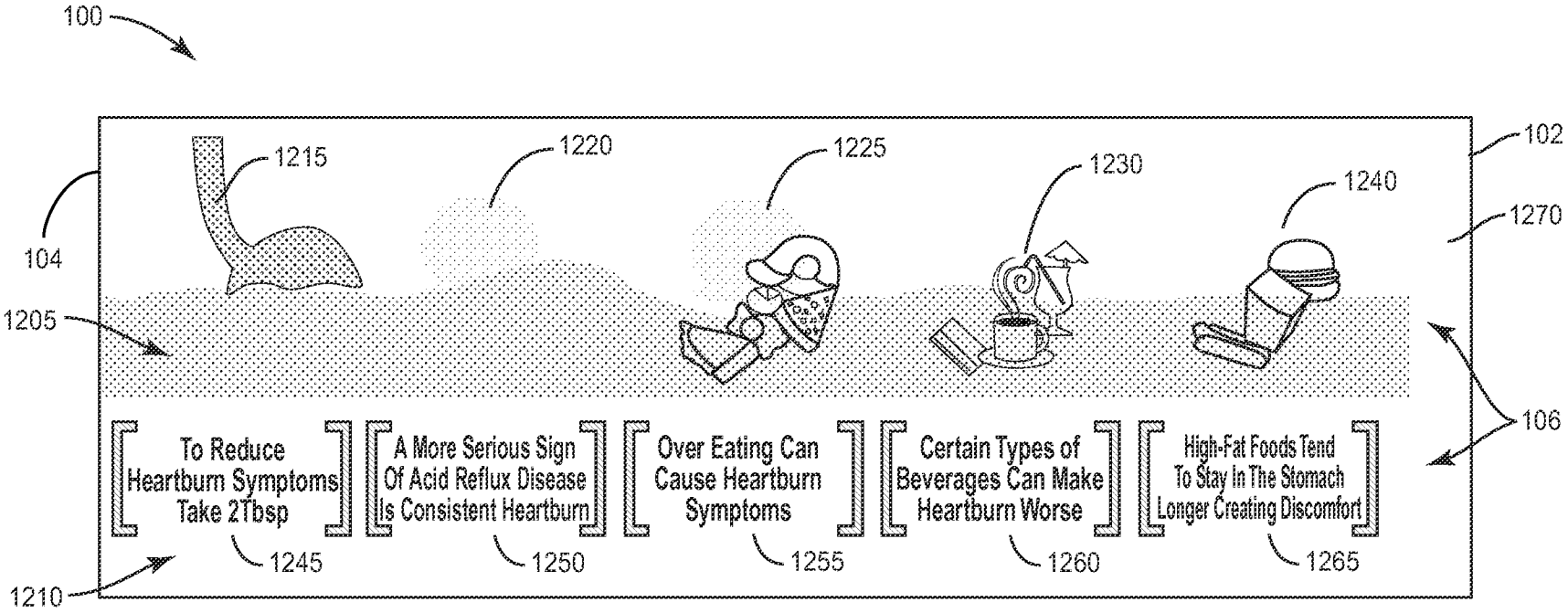
FIG. 12 is a front view of a base label according to various embodiments.
Figure 13:
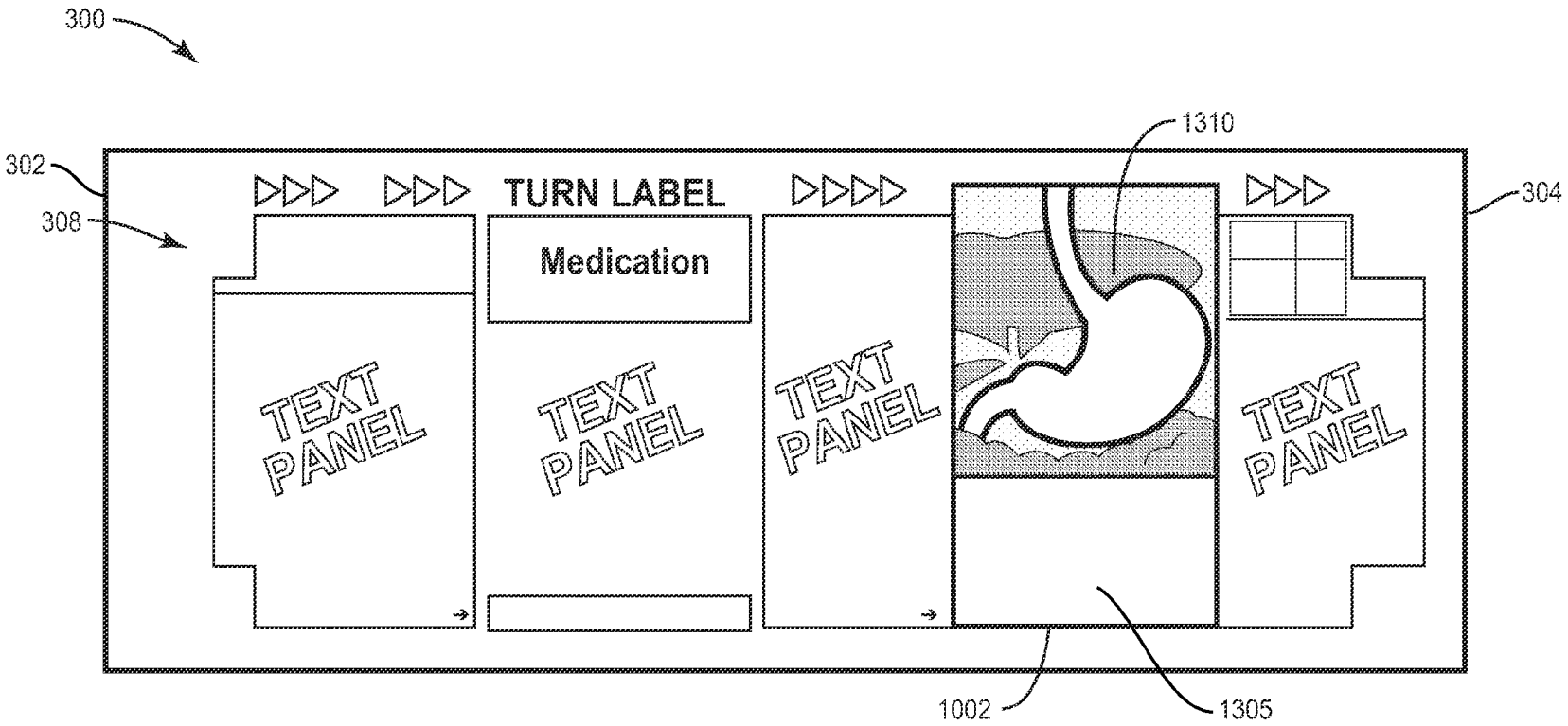
FIG. 13 is a front view of a top label according to various embodiments.

FIGS. 12 and 13 illustrate a base label 100 and top label 300, respectively, that may comprise a rotating label medical information system for a container, such as a container 1405 (see FIG. 14) according to various embodiments. The base label indicia 106 may comprise a graphical illustration section 1205 and a text information section 1210. Although both the graphical illustration section 1205 and the text information section 1210 are shown in FIG. 12, various embodiments may include one of the graphical illustration section 1205 or the text information section 1210.

The graphical illustration section 1205 may comprise a plurality of individual first illustrations 1215-1240 (or images) representing at least a first item of medical information such as medical conditions, effects of taking medication, effects of not taking medication, potential drug interactions, or any other information the manufacturer of the medication in the container 1405 may desire to present to the consumer. In various embodiments, the first illustrations 1215-1240 may indicate progressively improving conditions related to taking the medication or progressively worsening conditions related to not taking the medication. In various embodiments, the first illustrations 1215-1240 may comprise a portion of a graphical representation that, when interacting with the top label 300 as described in detail below, forms a complete visual aid. The first illustrations 1215-1240 may be depicted in any color or combination of colors and may include any combination of alphanumeric characters.

In various embodiments, the text information section 1210 may comprise a plurality of individual messages 1245-1265 representing at least a second item of medical information, such as instructions, explanations, facts, or other information that coincide with and may be related to at least one of the first illustrations 1215-1240 in the graphical illustration section 1205. While FIG. 12 depicts the first illustrations 1215-1240 and the messages 1245-1265 vertically aligned with one another, other positioning is within the scope of the present disclosure.

The base label 100 may have a blank portion 1270 along the leading edge 102 that is essentially void of any base label indicia 106. As described previously, the trailing edge 104 may overlap the leading edge 102 when the base label 100 is applied to the container 1405. The blank portion 1270 provides a space for attachment of the trailing edge 104 without obscuring any of the base label indicia 106.

As illustrated in FIG. 13, various embodiments of the top label 300 may comprise indicia 308 relaying product-related information, safety-related information, manufacturer-related information, and the like. In various embodiments, the top label 300 may contain a window 1002 as described previously (see FIG. 10). The window 1002 may be divided into a transparent section 1305 and a semi-transparent section 1310. In the context of the present disclosure, "semi-transparent" is understood to mean that at least a portion of the section may be opaque or translucent, and at least a portion may be transparent. The semi-transparent section 1310 may comprise opaque markings thereon. The opaque markings may comprise a second illustration (or image) germane to the medication in the container 1405. For example, the medication may be for the treatment of heartburn, and the opaque markings in FIG. 13 may comprise an image of a stomach which is the source of the acidic material that causes heartburn. The opaque markings in various embodiments may define one or more non-opaque areas within the semi-transparent section 1310. A portion of the base label 100 may be visible through the non-opaque areas within the semi-transparent section 1310 and the transparent section 1305 when the top label 300 is positioned over the base label 100 as described more fully below. In various embodiments, the window 1002 may comprise the semi-transparent section 1310, and the transparent section 1305 may comprise a second transparent window. The transparent window 1002 and the second transparent window may be placed within separate portions of the top label 300. The separate portions may be adjacent as illustrated in FIG. 13, or may be spaced apart.

Figure 14:
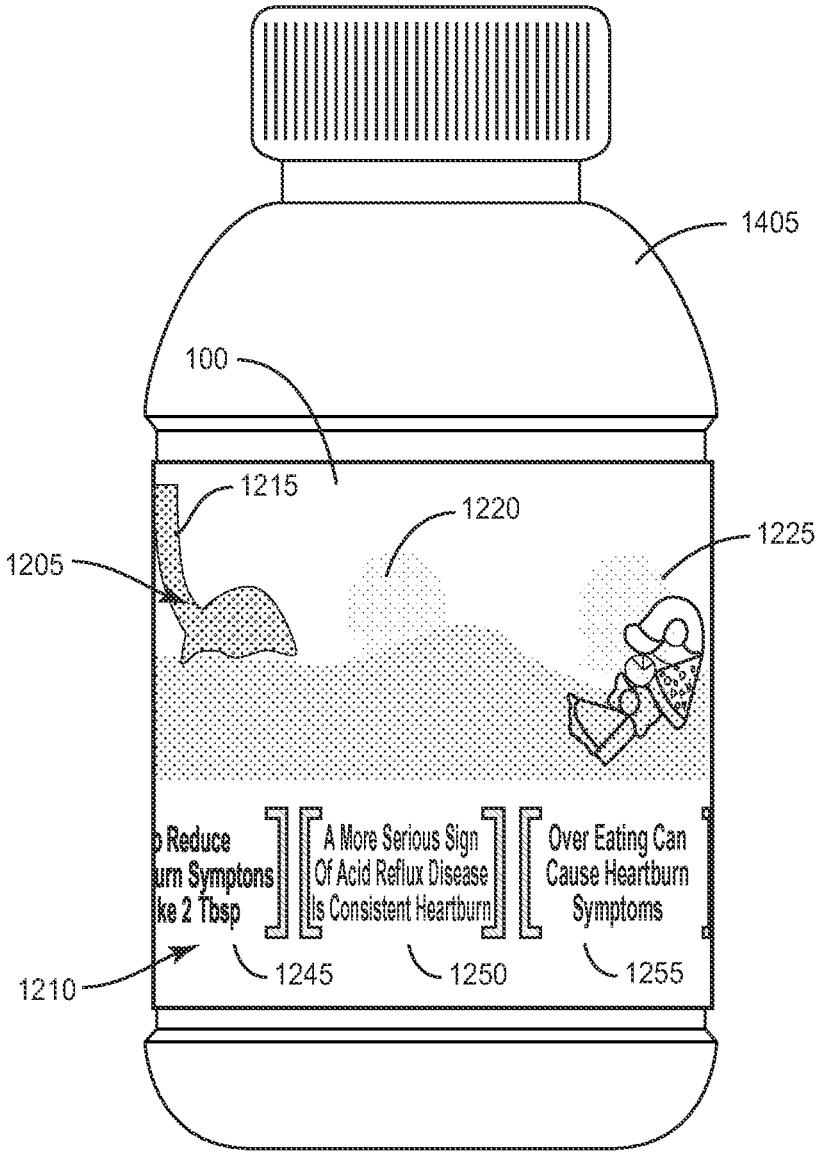
FIG. 14 illustrates an exemplary base label secured about a container according to various embodiments.
Figure 15A:
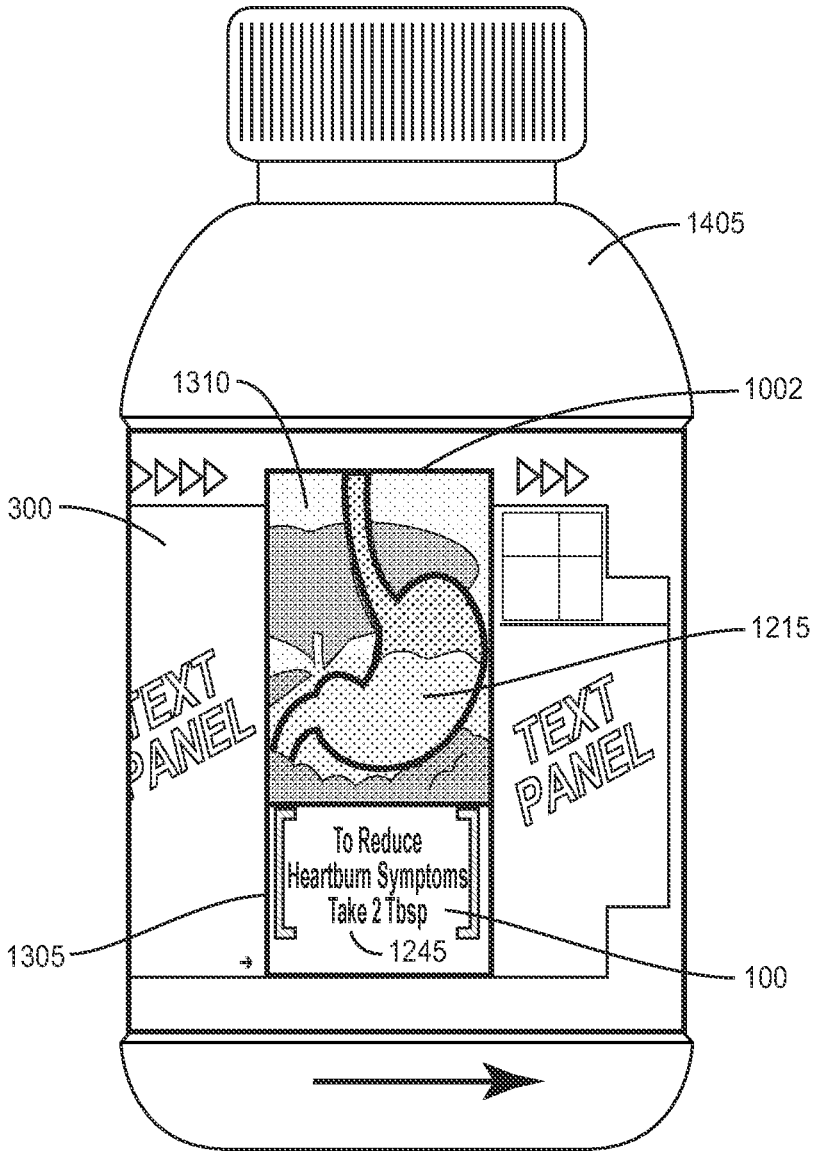
FIG. 15A illustrates an exemplary base label and top label secured about a container according to various embodiments.
Figure 15B:
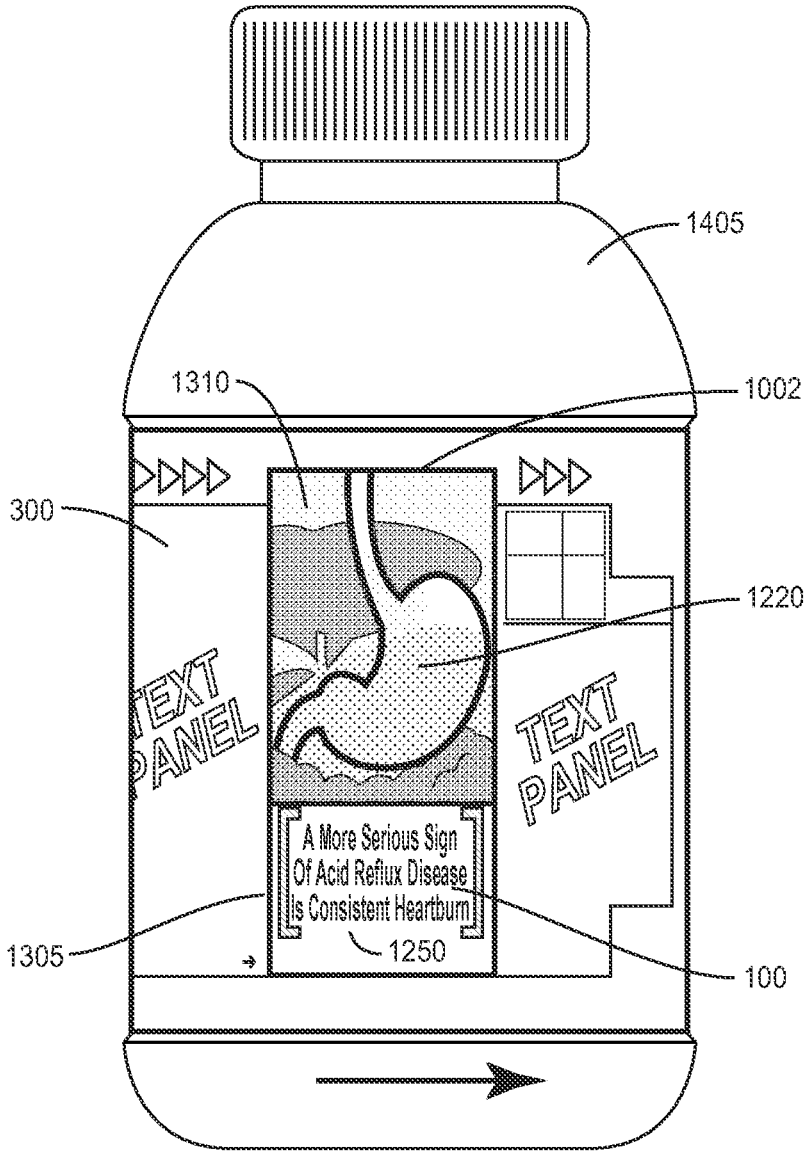
FIG. 15B illustrates an exemplary base label and top label secured about a container according to various embodiments.
Figure 15C:
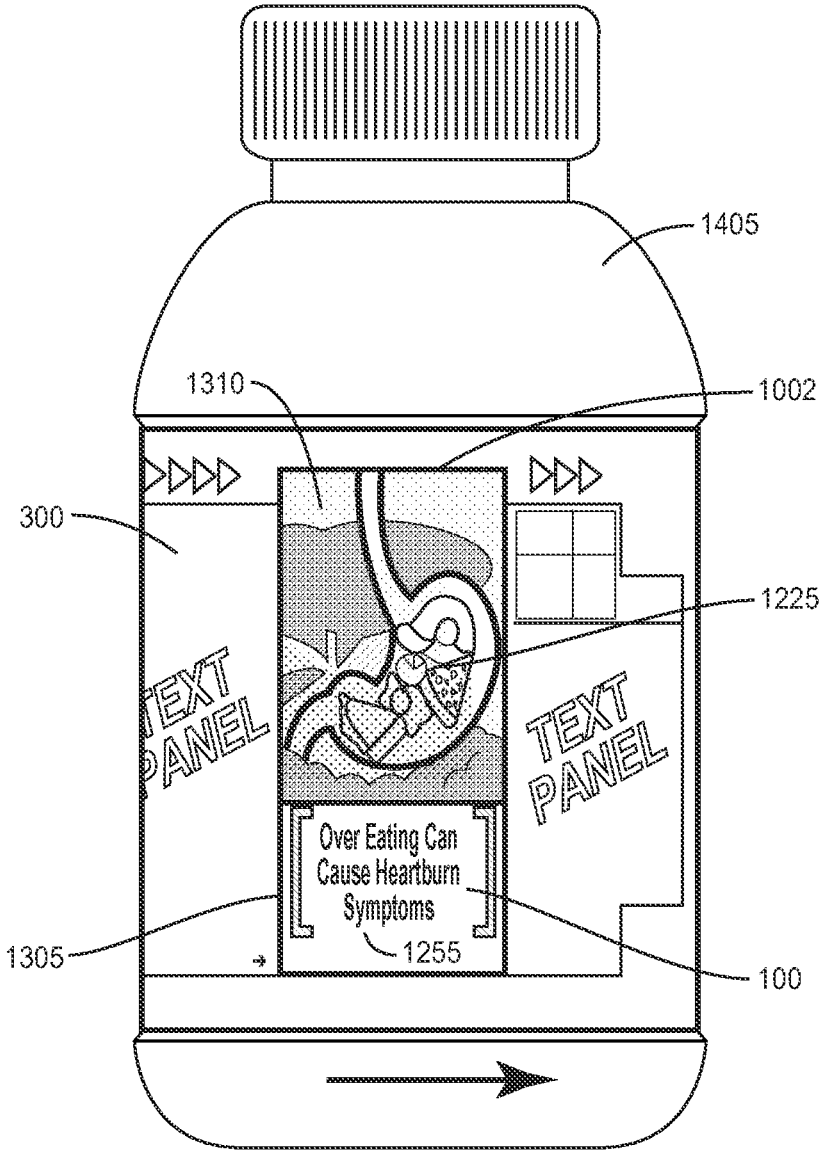
FIG. 15C illustrates an exemplary base label and top label secured about a container according to various embodiments

FIG. 14 illustrates the base label 100 positioned on the container 1405 according to various embodiments. As discussed above, the base label indicia 106 may comprise the graphical illustration section 1205 and the text information section 1210 printed on the front surface of the base label 100 such that the graphical illustration section 1205 and the text information section 1210 at least partially encircle the container 1405. FIGS. 15A through 15C illustrate the top label 300 in place over the base label 100 on the container 1405 according to various embodiments. The base label 100 and the top label 300 may comprise a medical condition rotating label system that may be used on the medication container 1405 to provide additional functionality to interactively illustrate information relating to the cause and symptoms of the medical condition to be treated by the medication, beneficial and adverse effects of the medication, or any other visual information. Providing such visual information may be advantageous to a consumer because the interactive and visual presentation of the information may lead to better understanding of the medical condition and its treatment. Better understanding by the consumer may result in more consistent consumption of the medication and more effective treatment of the medical condition. The visual information may be beneficial to the manufacturer of the product in the container 1405 by reducing the cost of the packaging and promoting increased consumption of the product.

FIG. 15A illustrates the top label 300 in place over the base label 100. As described previously, the top label 300 may be applied such that the top label 300 is rotatable around a circumference of the container 1405. In FIG. 15A, the top label 300 has been rotated in the direction of the arrow revealing at least one of the first illustrations 1215-1240 (in this example, first illustration 1215) through the semi-transparent section 1310 of the window 1002 in the top label 300. The first illustration 1215 may align with the second illustration in the semi-transparent section 1310. When such alignment is achieved, the first illustration 1215 may combine with the opaque markings (the second illustration) of the semi-transparent section 1310 to form an interactive visual aid according to various embodiments. In the example of FIG. 15A, the interactive visual aid is a depiction of a stomach with acid reflux extending into the esophagus.

In various embodiments, at least one of the messages 1245-1265 (in this example, message 1245) may be revealed simultaneously in the transparent section 1305 of the window 1002. The message 1245-1265 may compliment the visual aid created by the first illustration 1215-1240 and the opaque markings of the semi-transparent section 1310 of the window 1002. In the example of FIG. 15A, the consumer may rotate the top label 300 to reveal a visual aid representing the consumer's current medical condition (i.e., heartburn), and the message 1245 revealed in the transparent section 1305 of the window 1002 may provide, for example, dosing information or effects of consuming the dose. In this example, the message presented to the consumer is, "To Reduce Heartburn Symptoms Take 2 Tbsp".

FIGS. 15B and 15C further illustrate the interactive nature of the medical condition rotating label system according to various embodiments. As the consumer further rotates the top label 300 in the direction of the arrow, a different one of the first illustrations 1215-1240 may be displayed through the semi-transparent section 1310 of the window 1002 and a different one of the messages 1245-1265 through the transparent section 1305 of the window 1002. In the example of FIG. 15B, the top label 300 has been rotated until the first illustration 1220 is displayed in the semi-transparent section 1310. The first illustration 1220 may combine with the opaque markings of the semi-transparent section 1310 to now depict a more serious case of heartburn. The corresponding message 1250 displayed through the transparent section 1305 may provide general information about the more serious condition such as, "A More Serious Sign of Acid Reflux Disease Is Consistent Heartburn". In this example, the message 1250 provides general informational concerning the medical condition rather than specific information related to the use of the medication. FIG. 15C depicts the top label 300 further rotated such that first illustration 1225 is displayed in the semi-transparent section 1310 and message 1255 is displayed in the transparent section 1305. This example illustrates additional general information presented to the consumer. The message 1255 states, "Over Eating Can Cause Heartburn Symptoms," and the combination of the first illustration 1225 and the opaque markings of the semi-transparent section 1310 depict a stomach full of food. The combination of the first illustration 1215-1240, the opaque markings, and the message 1245-1265 provides a visual aid that may help the consumer to better comprehend the medical condition and its treatment, as well as to more readily remember the information presented by the manufacturer of the medication or the health care provider.

Figure 16:
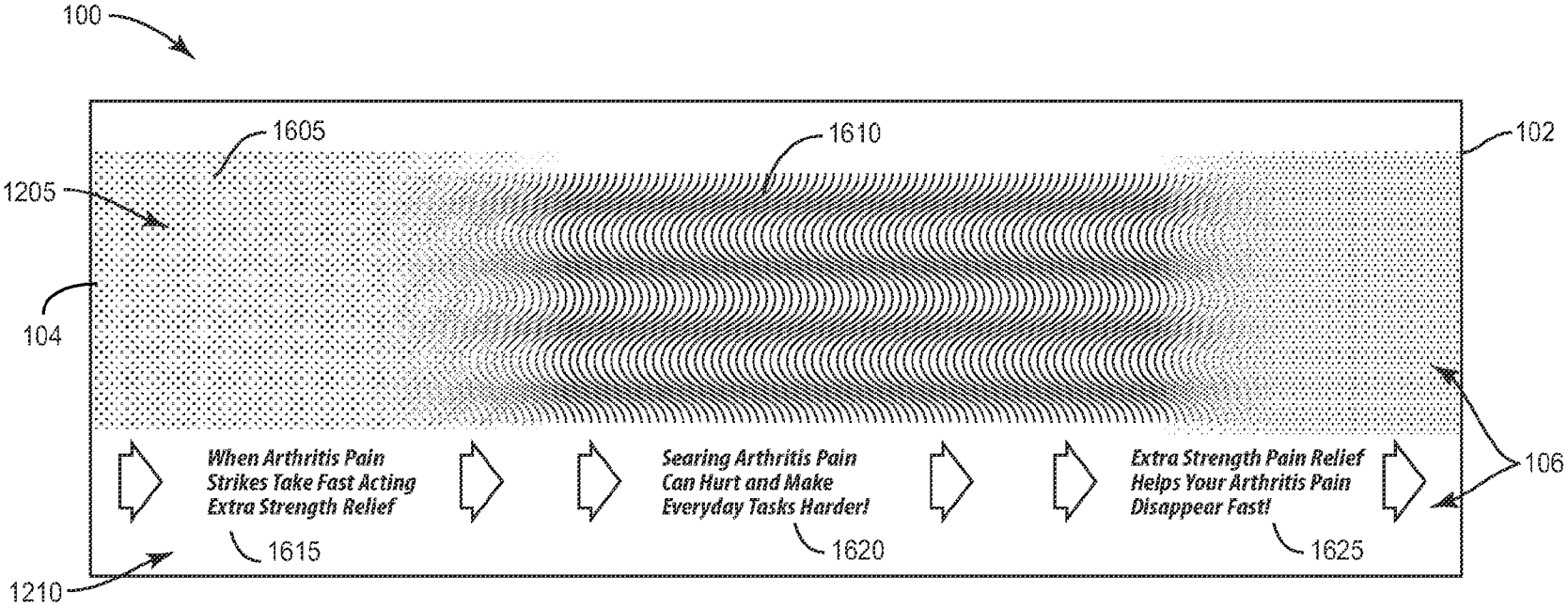
FIG. 16 is a front view of a base label according to various embodiments.
Figure 17:
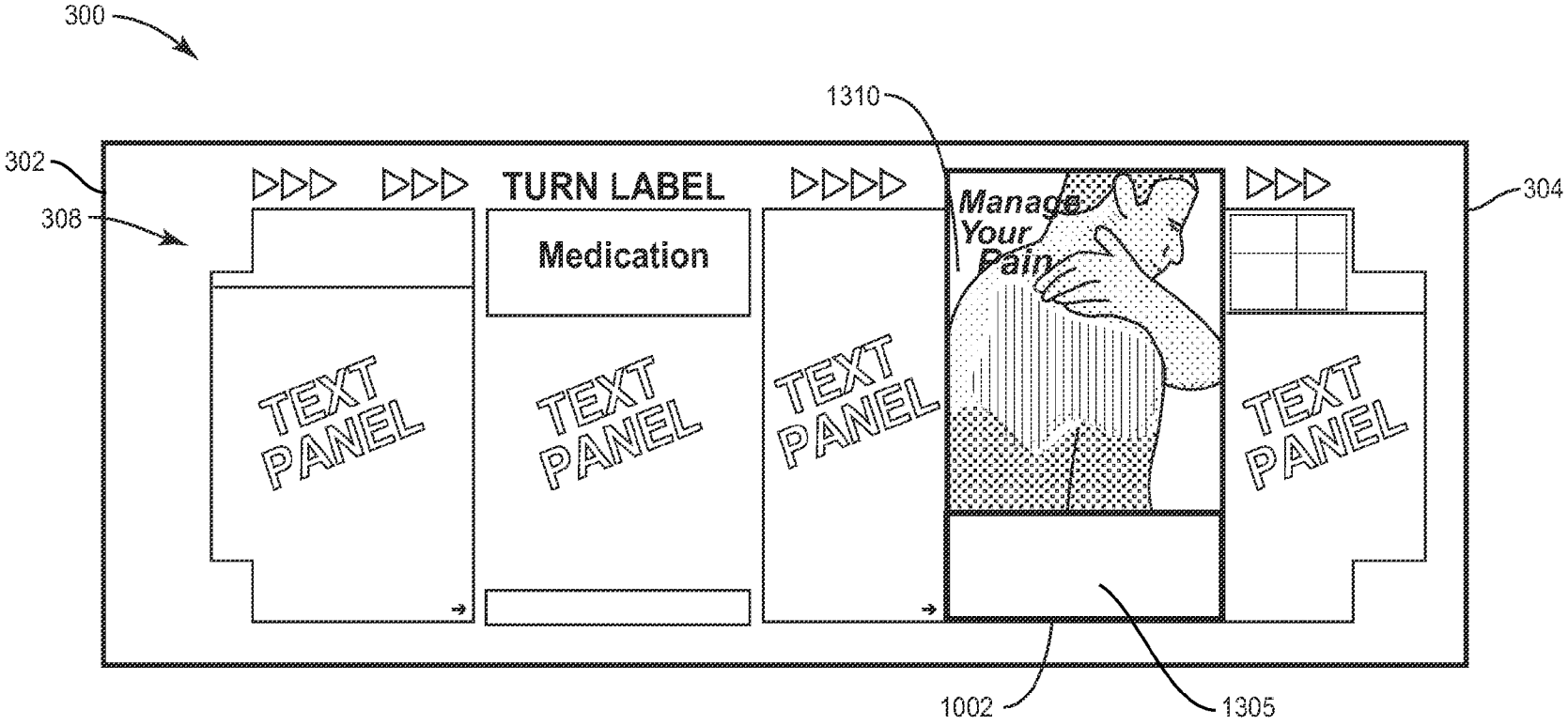
FIG. 17 is a front view of a top label according to various embodiments.

As one skilled in the art will readily recognize, any type of visual representation comprising overlapping images or side-by-side images is within the scope of the present disclosure. FIGS. 12 and 13 illustrate a simple overlap of multiple images to form a desired static visual aid. More interactive visual aids may be created by using techniques to produce animated images. For example, FIGS. 16 and 17 illustrate various embodiments of a base label 100 and a top label 300, respectively, adapted to produce an animated visual aid with the use of barrier grid animation. Barrier grid animations may comprise a barrier image (or barrier grid) and an animated image.

As described previously for FIG. 12, the base label indicia 106 may comprise a graphical illustration section 1205 and a text information section 1210. Rather than a plurality of individual first illustrations such as first illustrations 1215-1240 of FIG. 12, the graphical illustration section 1205 according to the embodiments of FIG. 16 may comprise an animated image section 1610, such as a moiré pattern, and a non-animated image section 1605. The text information section 1210 may comprise individual messages 1615-1625 similar to that described previously for FIG. 12.

The semi-transparent section 1310 of the window 1002 of the top label 300 may comprise opaque markings that define a second illustration (for example, in FIG. 17 the opaque markings depict at least a portion of a human form, such as the head, neck, back, and shoulders). The opaque markings may further define one or more areas comprising a barrier grid.

Figure 18:
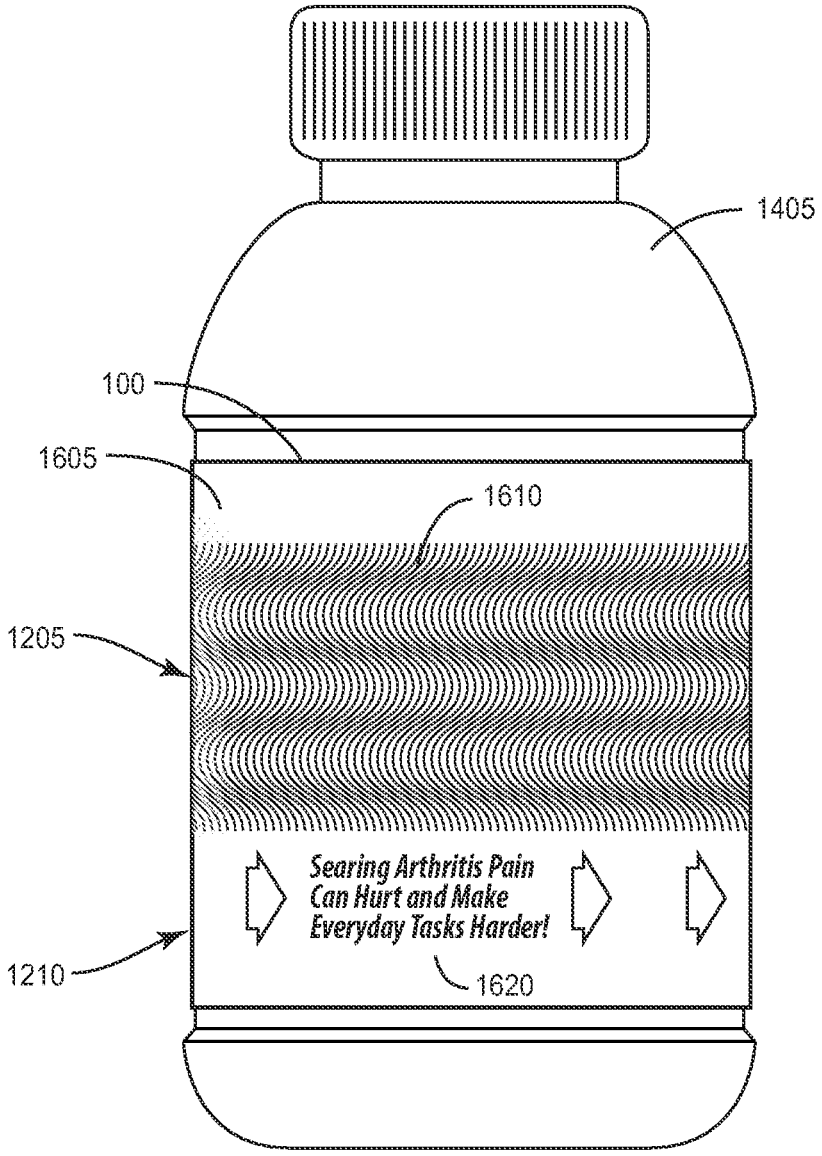
FIG. 18 illustrates an exemplary base label secured about a container according to various embodiments.

FIG. 18 illustrates the base label 100 of FIG. 16 positioned on the container 1405 according to various embodiments. The graphical illustration section 1205 and the text information section 1210 may at least partially encircle the container 1405.

Figure 19A:
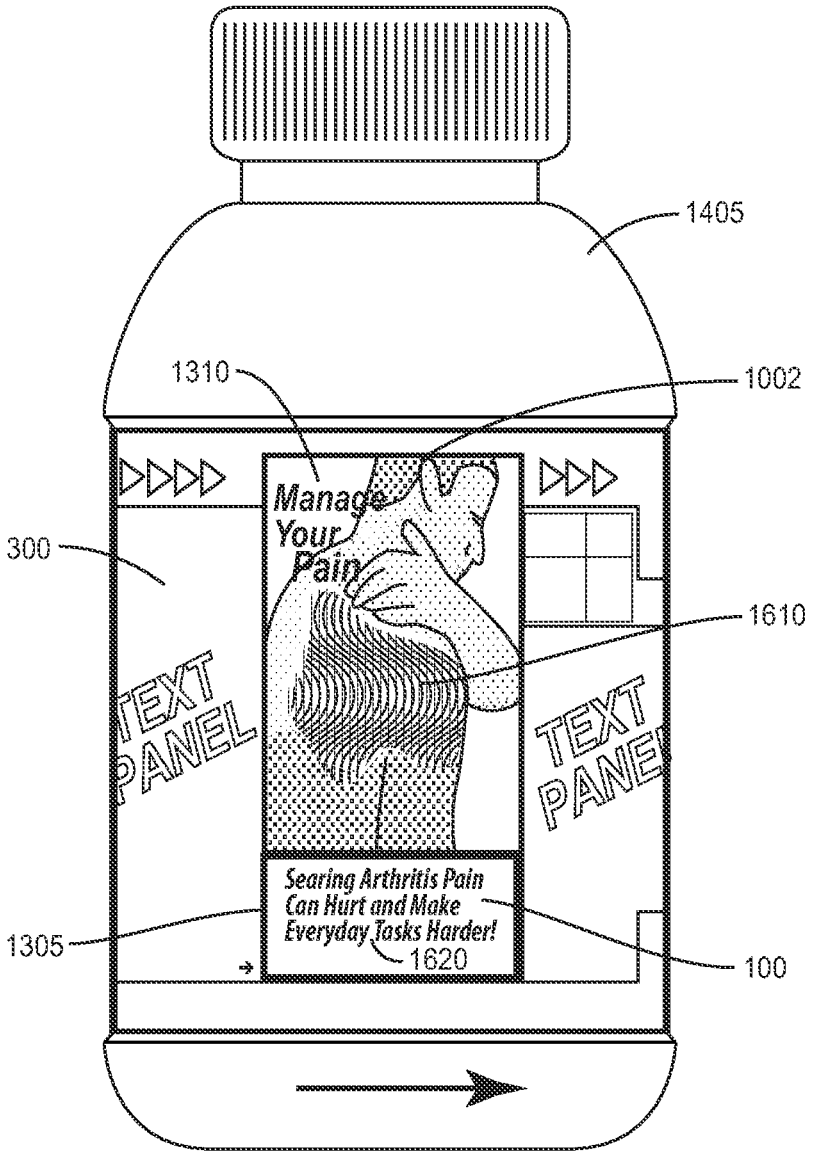
FIG. 19A illustrates an exemplary base label and top label secured about a container according to various embodiments.
Figure 19B:
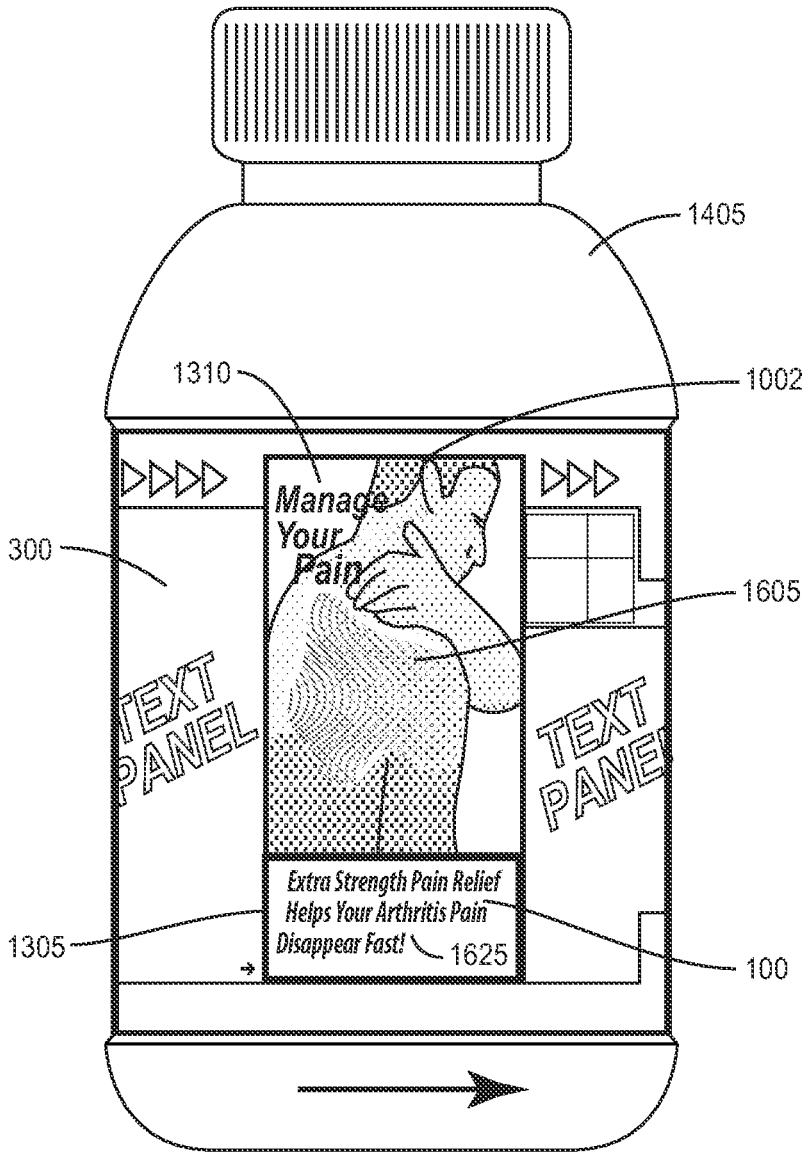
FIG. 19B illustrates an exemplary base label and top label secured about a container according to various embodiments.

FIG. 19A illustrates the top label 300 in place over the base label 100. The top label 300 may be rotatable around a circumference of the container 1405. As the top label 300 is rotated to the position illustrated in FIG. 19A, the animated image section 1610 may be positioned under the barrier grid of the semi-transparent section 1310 of the window 1002 of the top label 300. The interaction of the barrier grid and the animated image section 1610 may produce an animated effect of waving lines, which may be understood by the consumer to represent intense shoulder pain. As the top label 300 is further rotated as depicted in FIG. 19B such that the non-animated section 1605 of the base label 100 is positioned under the barrier grid, then a non-motion image may be displayed that corresponds to relieved or lessened pain.

Figure 20:
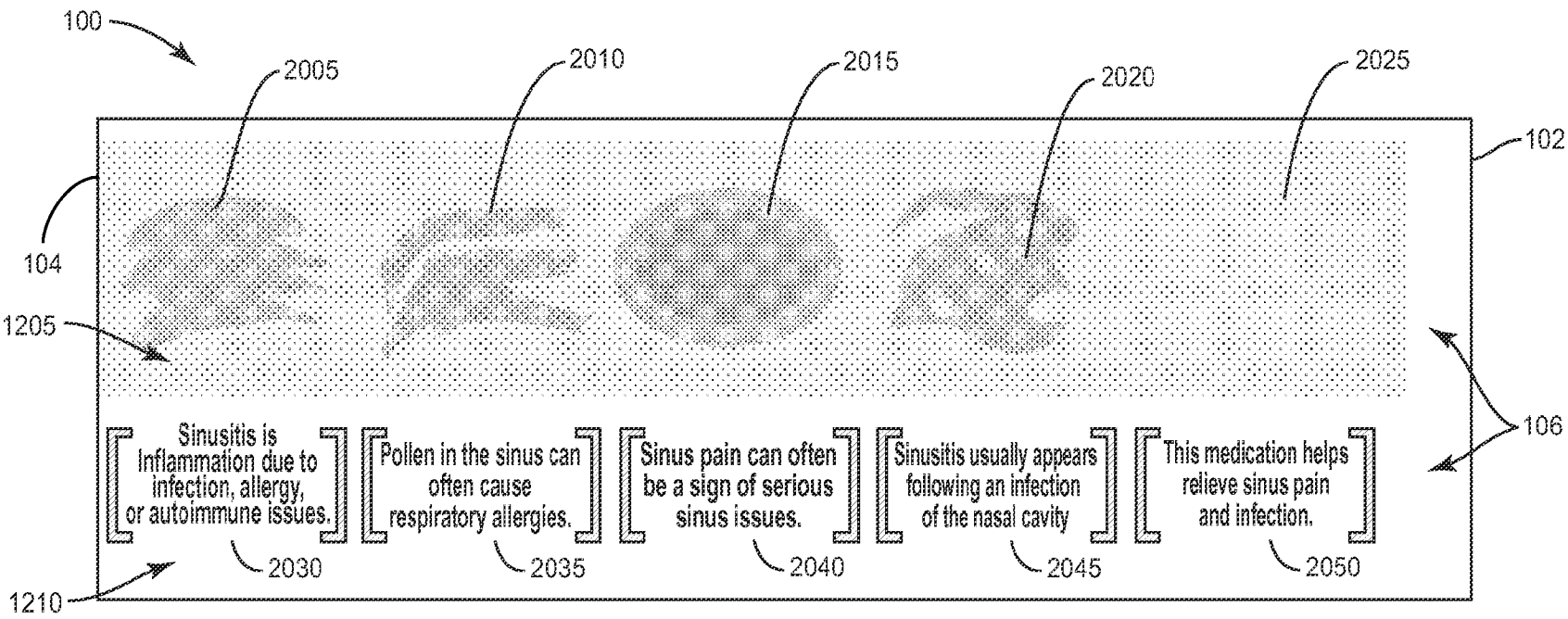
FIG. 20 is a front view of a base label according to various embodiments.
Figure 21:
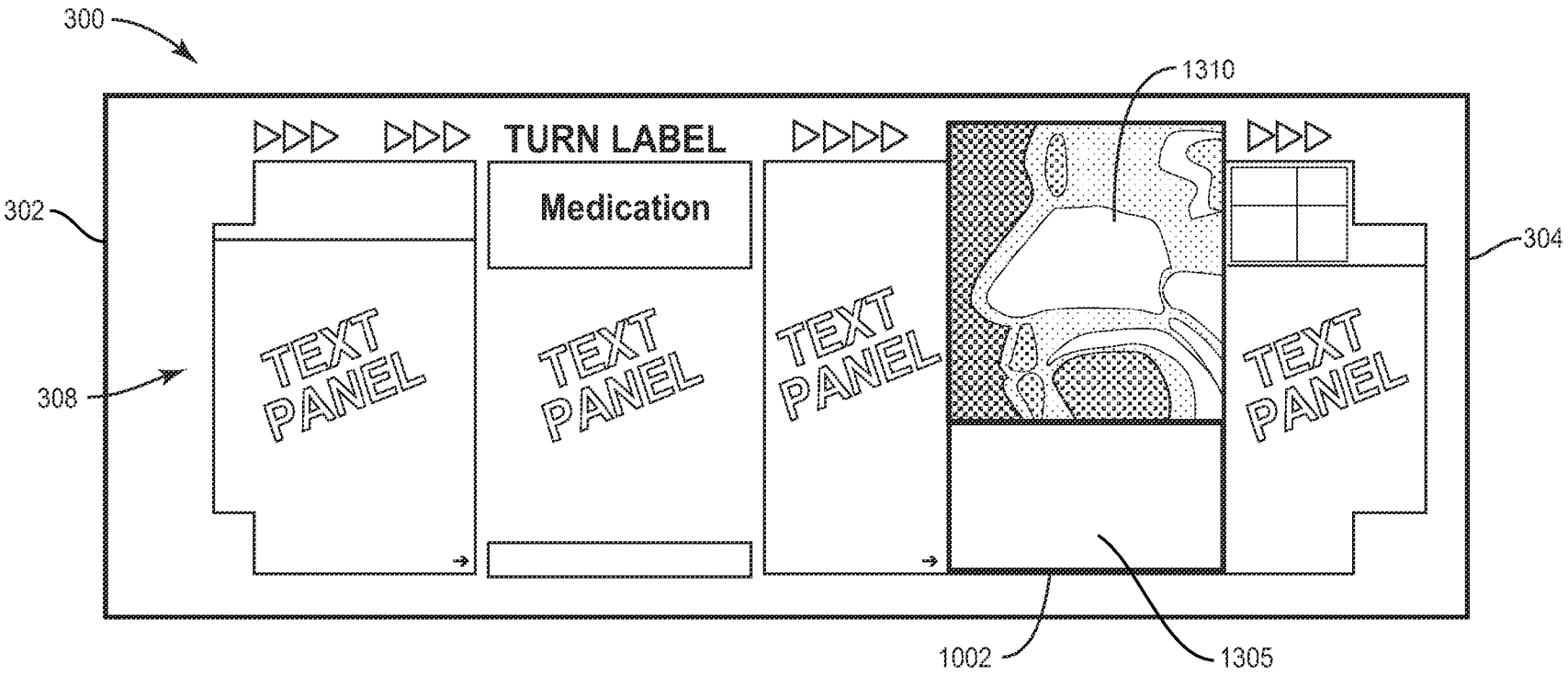
FIG. 21 is a front view of a top label according to various embodiments.

FIGS. 20 and 21 illustrate further various embodiments of overlapping images on the base label 100 and top label 300, respectively. In this example, the opaque markings of the semi-transparent section 1310 of the window 1002 of the top label 300 depict a sinus cavity. A portion of the sinus cavity image may be transparent to allow one or more of the individual first illustrations 2005-2025 to be visible when the base label 100 and the top label 300 overlap. The first illustrations may illustrate conditions within the sinus cavity.

Figure 22:
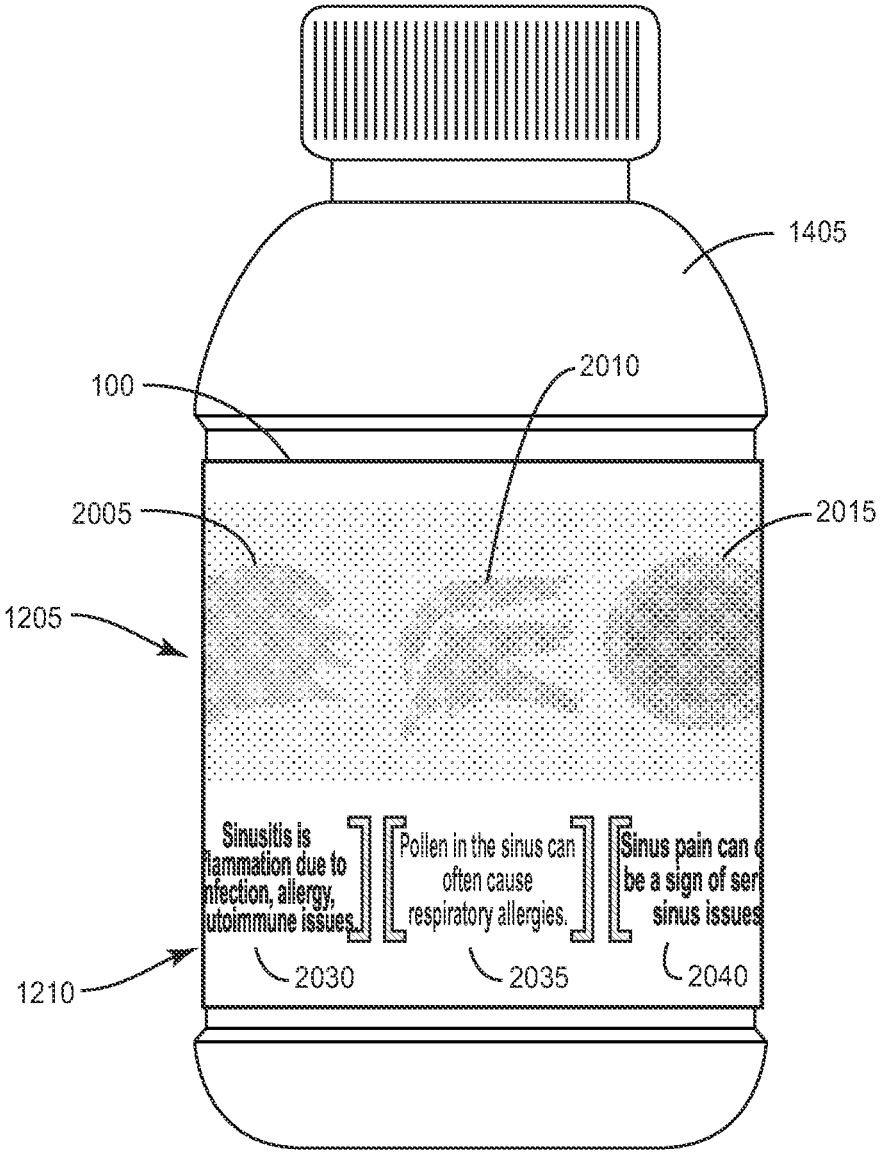
FIG. 22 illustrates an exemplary base label secured about a container according to various embodiments.

FIG. 22 illustrates the base label 100 of FIG. 20 positioned on the container 1405 according to various embodiments. The graphical illustration section 1205 and the text information section 1210 may at least partially encircle the container 1405.

Figure 23A:
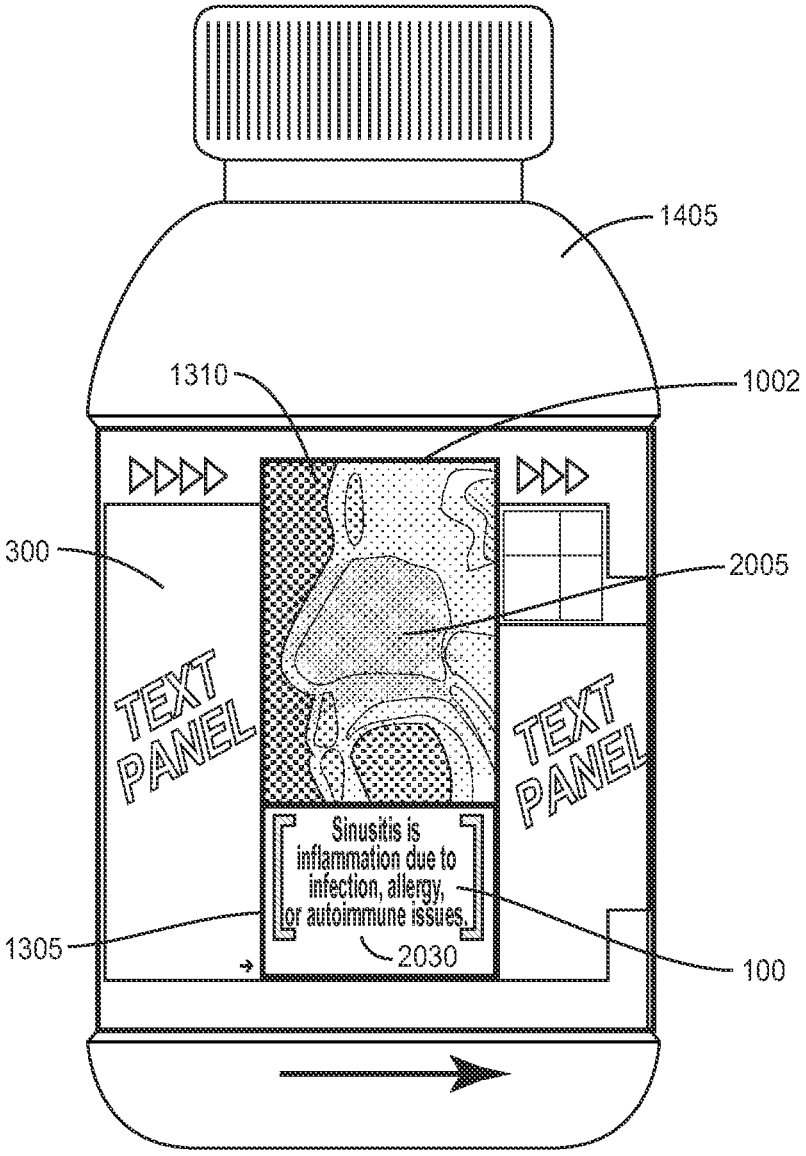
FIG. 23A illustrates an exemplary base label and top label secured about a container according to various embodiments.

FIG. 23A illustrates the top label 300 in place over the base label 100. The top label 300 may be rotatable around a circumference of the container 1405. As the top label 300 is rotated to the position illustrated in FIG. 23A, at least one of the first illustrations 2005-2025 (in this example, first illustration 2005) may be visible through the semi-transparent section 1310 of the window 1002 of the top label 300. The first illustration 2005 may align with the second illustration in the semi-transparent section 1310. When such alignment is achieved, the first illustration 2005 may combine with the opaque markings (the second illustration) of the semi-transparent section 1310 to form an interactive visual aid according to various embodiments. In the example of FIG. 23A, the interactive visual aid is a depiction of a swollen sinus cavity. Additionally, the message 2030 corresponding to the first illustration 2005 may be visible through the transparent section 1305 of the window 1002 to augment the visual aid created by the overlap of the of the top label 300 and the base label 100.

Figure 23B:
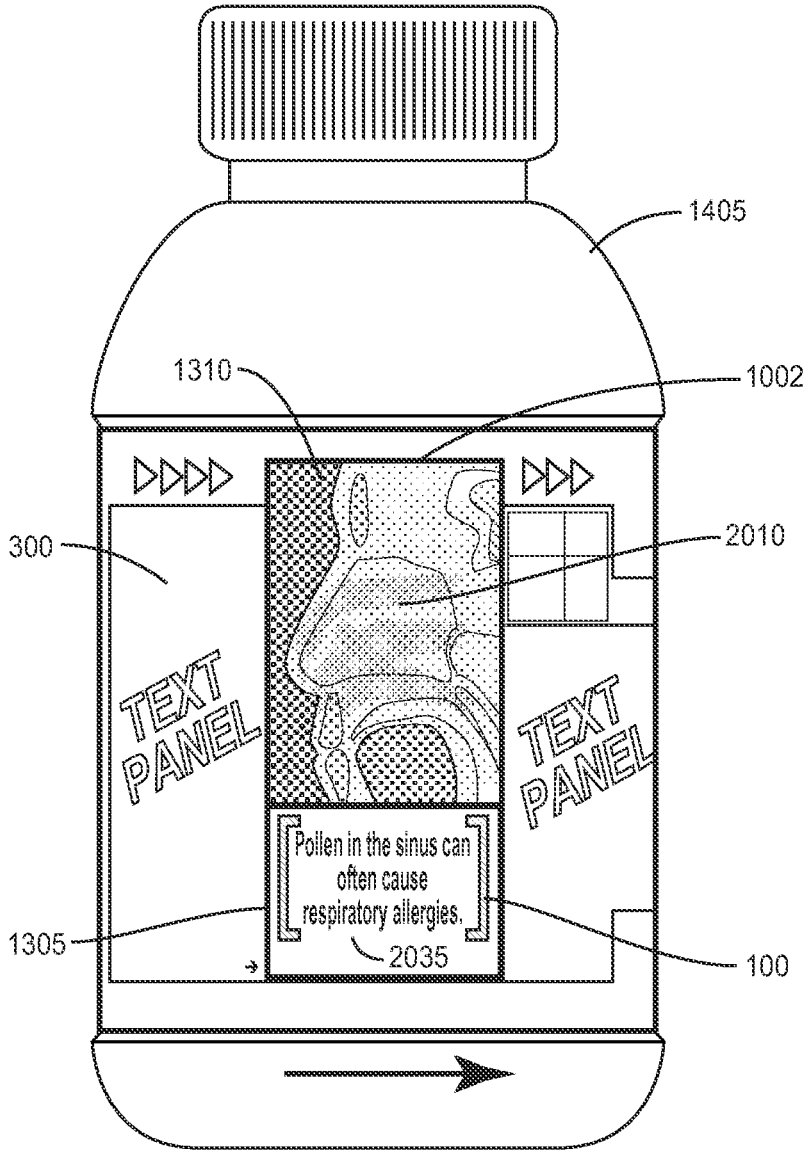
FIG. 23B illustrates an exemplary base label and top label secured about a container according to various embodiments.

Further rotation of the top label 300 in the direction indicated by the arrow in FIG. 23B may cause a different one of the first illustrations 2005-2025 to be displayed through the semi-transparent section 1310 of the window 1002 and a different one of the messages 2030-2050 to be displayed through the transparent section 1305 of the window 1002.

In various embodiments, the first illustrations 2005-2025 may be printed in a variety of colors to further enhance the effect of the visual aid. For example, various shades of red could be used for each of the first illustrations 2005-2025 to depict different intensities of sinus inflammation. In addition, the intensity of the shading may vary from one first illustration 2005-2025 to the other to depict the intensity of the sinus inflammation. For example, the first illustration 2005 may be depicted in a dark and intense shade of red to indicate a severe case of sinus infection, while the first illustration 2025 may be depicted in a light shade of red that is only marginally visible to indicate the relieving effects of the medication.

Figure 24:
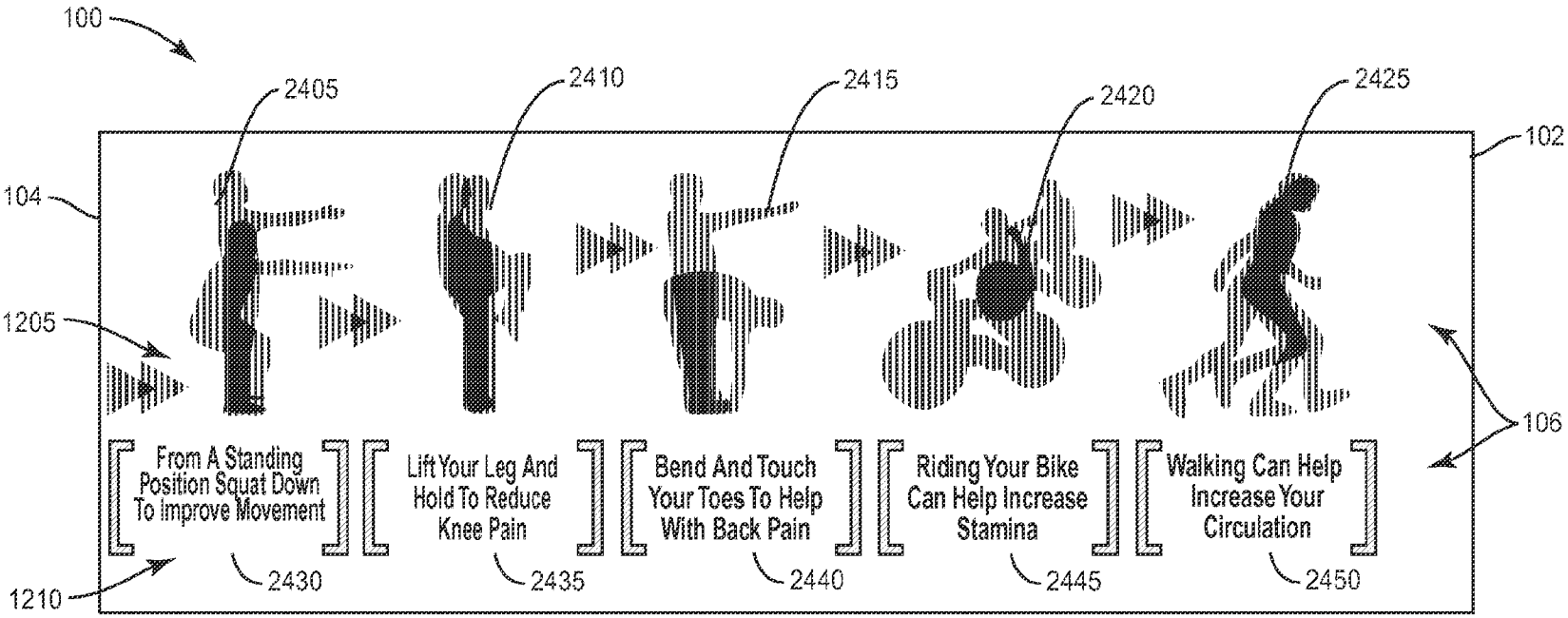
FIG. 24 is a front view of a base label according to various embodiments.
Figure 25:
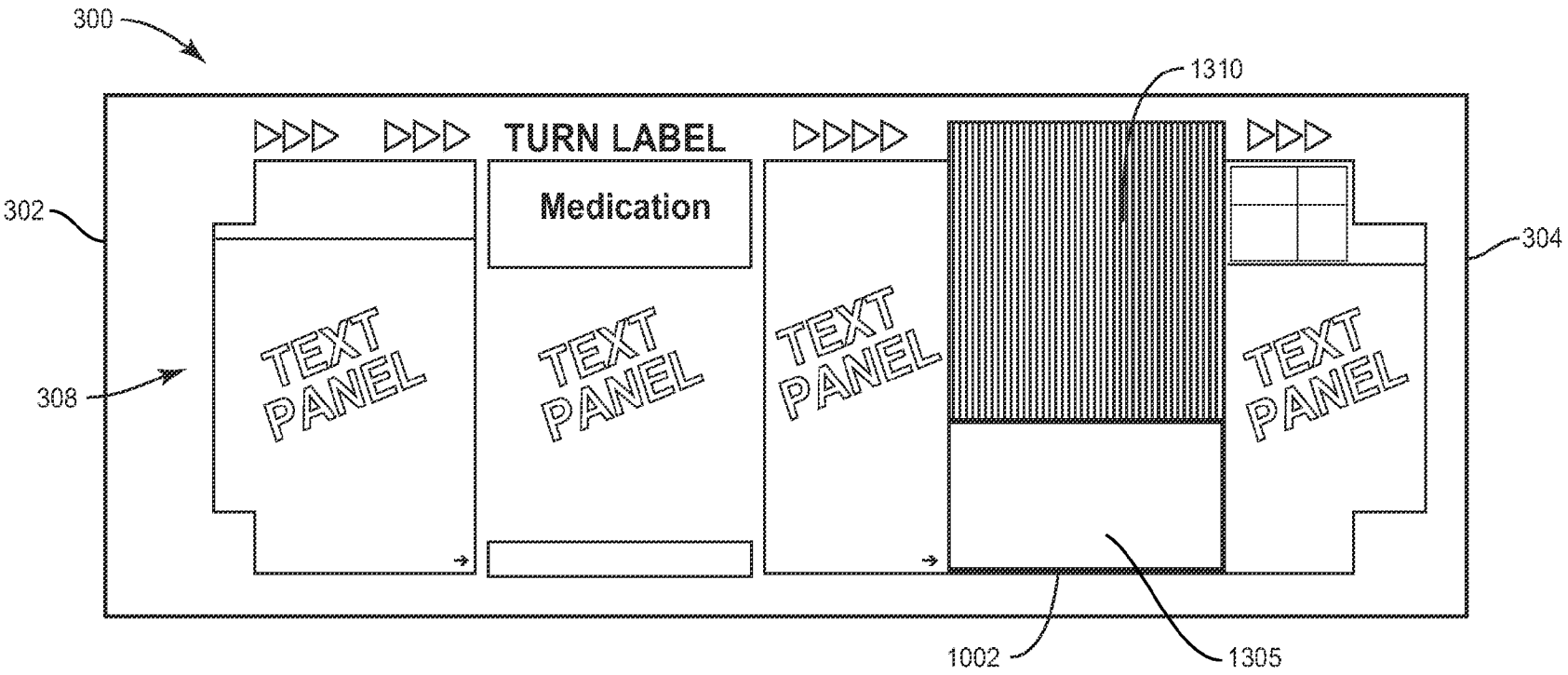
FIG. 25 is a front view of a top label according to various embodiments.

FIGS. 24 and 25 further illustrate the use of barrier grid animation to produce an animated visual aid. The graphical illustration section 1205 of the base label indicia 106 may comprise a plurality of individual first illustrations 2405-2425. Each first illustration 2405-2425 may comprise two or more animated images, where the animated images are separated into thin strips and merged together such that each image is slightly offset from the next. For example, first illustration 2405 comprises an image of a person in a standing position and an image of a person is a squatting position. The base label 100 may also comprise a text information section 1210 comprising a plurality of individual messages 2430-2450 as described previously.

In various embodiments as illustrated in FIG. 25, the window 1002 may comprise a semi-transparent section 1310 comprising a series of spaced apart lines (i.e., the barrier image). A distance between the spaced apart lines may be approximately equal to a distance between the strips of the animated images of the first illustrations 2405-2410.

Figure 26:
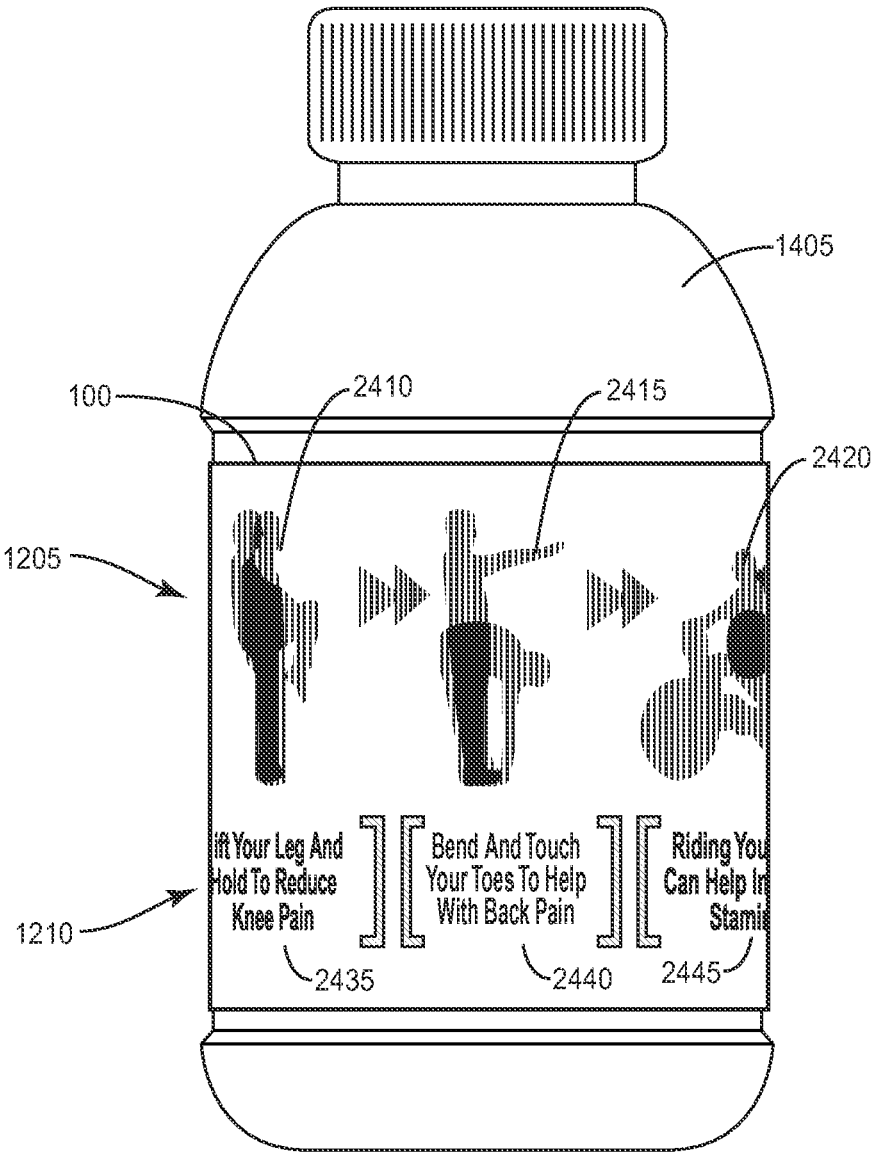
FIG. 26 illustrates an exemplary base label secured about a container according to various embodiments.
Figure 27A:
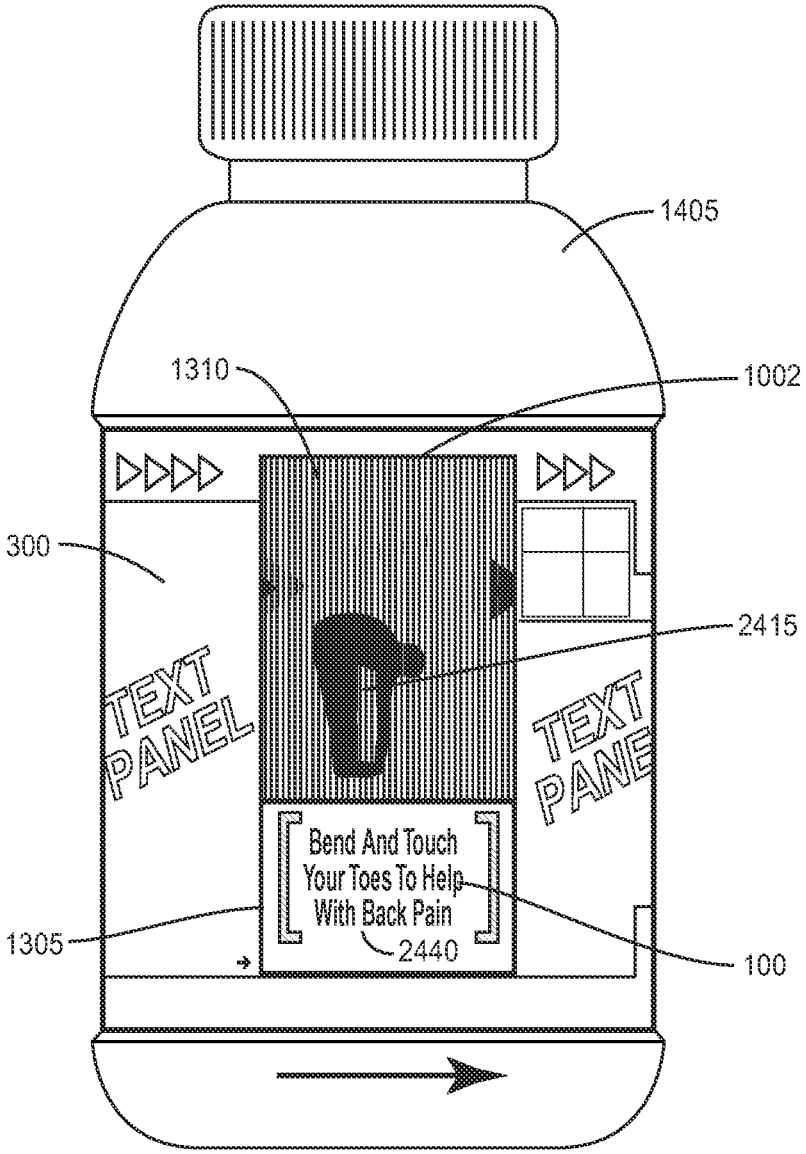
FIG. 27A illustrates an exemplary base label and top label secured about a container according to various embodiments.
Figure 27B:
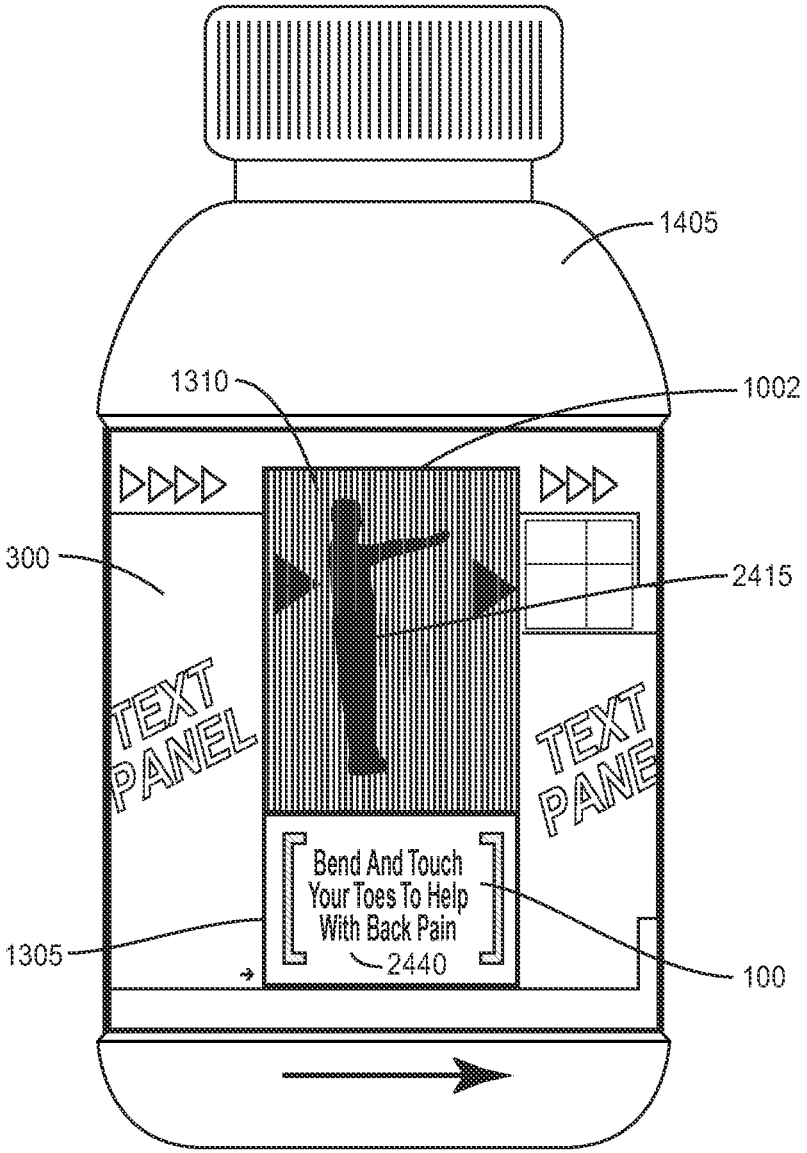
FIG. 27B illustrates an exemplary base label and top label secured about a container according to various embodiments.

FIG. 26 illustrates the base label 100 positioned on the container 1405 according to various embodiments. In FIG. 27A, the top label 300 is in place over the base label 100, and the top label 300 has been rotated such that the semi-transparent section 1310 is positioned over the first illustration 2415. The message 2440 corresponding to the first illustration 2415 may be visible in the transparent section 1305 of the window 1002. As illustrated in FIG. 27A, the barrier image of the semi-transparent section 1310 may be positioned such that the spaced apart lines are blocking the image of the person in a standing position, allowing the image of the person in a bent over position to be visible in the space between the spaced apart lines. In FIG. 27B, the top label has been rotated only slightly so that the spaced apart lines are now blocking the image of the person in a bent over position and allowing the image of the person in a standing position to be visible. Because the top image was rotated only slightly, message 2440 may be visible both in FIG. 27A and in FIG. 27B.

The top label 300 may comprise a dual ply (or multi-ply) construction in which a ply in contact with the base label 100 is a material selected for low sliding friction characteristics. The low sliding friction characteristics may enhance the ease of rotating and sliding the top label 300 about the base label 100. In various embodiments, the top label 300 ply in contact with the base label 100 may be coated with a substance to impart the low sliding friction characteristics.

Figure 28:
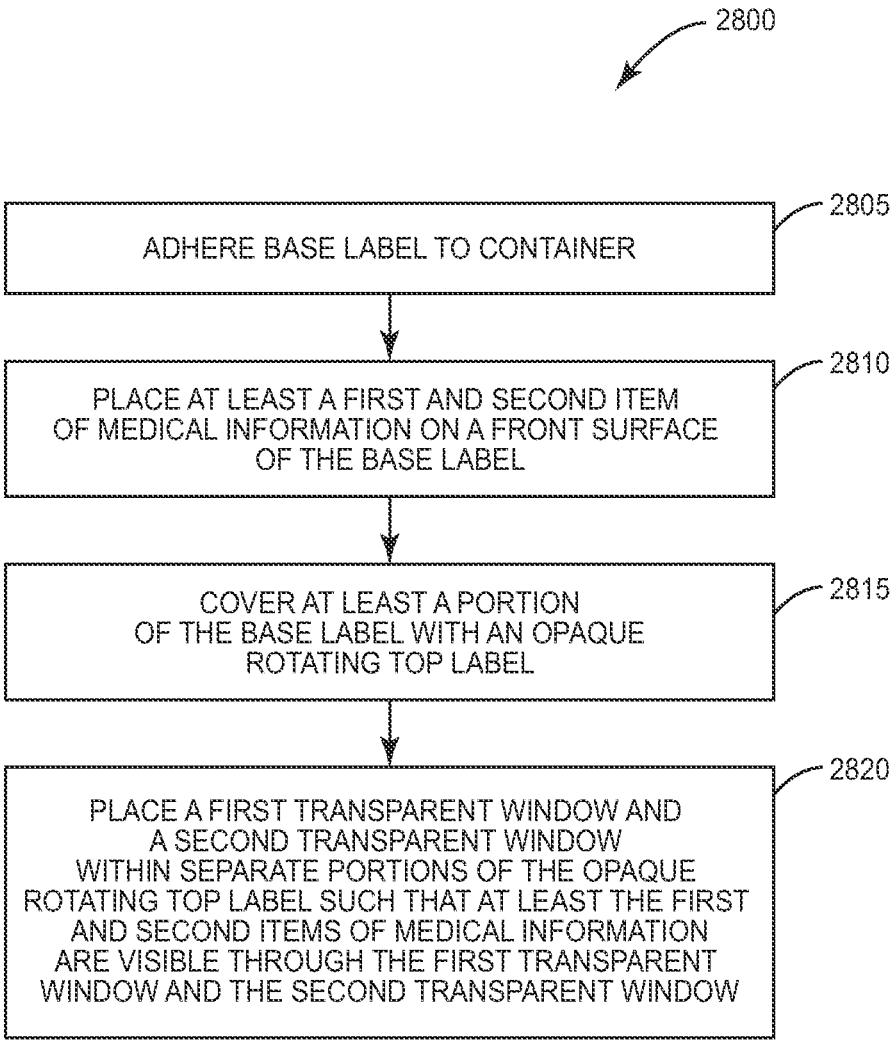
FIG. 28 is an exemplary flow diagram of a method for communicating medical information associated with a container according to various embodiments.

FIG. 28 illustrates a general flow chart of various embodiments of a method 2800 for communicating medical information associated with a container. A base label 100 may be applied to a container 1405 (step 2805). The base label 100 may have a back surface 206 and a front surface 108. At least a first and second item of medical information may be printed or placed on the front surface 108 of the base label 100 (step 2810). At step 2815, at least a portion of the base label 100 may be covered with a rotating top label 300. In various embodiments, the base label 100 may be coupled to the container 1405 while the top label 300 is free to rotate about the base label 100. A window 1002 may be placed within a portion of the rotating top label 300 at step 2820. The window 1002 may comprise a first and a second transparent window placed within separate portions of the opaque rotating top label. The first and second transparent windows may be placed such that at least the first and second items of medical information are visible through the first and second transparent windows. As the top label 300 is rotated about the base label 100, one or more other items of medical information may alternately be visible through the first and second transparent windows. In various embodiments, more than one of the items of medical information may be visible through each of the first and second transparent windows.

In various embodiments, all or a portion of the base label indicia 106 may be imprinted, embossed, or molded directly on an outer surface of the container 1405 in place of all or a portion of the base label 100. The imprinting or embossing may be carried out using any printing or image transfer method known in the art. In various embodiments, the printing or image transfer method may be an offset process in which an image is transferred from a plate to an intermediate carrier, then to the outer surface of the container 1405. The offset process may also involve lithographic techniques. Other printing or image transfer methods may comprise, for example, flexography, pad printing, relief printing, rotogravure, screen printing, and electrophotography. According to various embodiments, the base label indicia 106 may be digitally printed on the outer surface of the container 1405 using, for example, inkjet printing or laser printing. Chemical printing technologies, such as blueprint or diazo print may also be used in various embodiments.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

As used herein, the terms "having", "containing", "including", "comprising", and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A rotating label medical information system for a container, the system comprising:

a base label adhered to the container, the base label having a back surface and a front surface;

at least a first item of medical information on the front surface of the base label, the first item comprising a first partial image;

at least a second item of medical information of the front surface of the base label, wherein the second item is textually displayed;

an opaque rotating top label covering at least a portion of the front surface of the base label; and a first transparent window and a second transparent window placed within separate portions of the opaque rotating top label, the first transparent window comprising a second partial image thereon, the first and second partial images aligning to form a complete image in the first transparent window and the second item of medical information visible in the second transparent window when the opaque top label is rotated about the base label.

2. The system of claim 1, wherein the second item of medical information is related to the complete image.

3. The system of claim 2, wherein the complete image depicts a medical condition and the second item of medical information textually describes the medical condition.

4. The system of claim 1, wherein the complete image depicts a portion of a human body.

5. The system of claim 4, wherein the complete image depicts a sinus cavity.

* * * * *